US007293725B2

(12) United States Patent
Moriya et al.

(10) Patent No.: US 7,293,725 B2
(45) Date of Patent: Nov. 13, 2007

(54) CONTROL METHOD OF A GAP ADJUSTER OF IMPACT CRUSHER AND A GAP ADJUSTER

(75) Inventors: Yukio Moriya, Kawasaki (JP); Hiroshi Yoshida, Kawasaki (JP); Tooru Nakayama, Kawasaki (JP); Yuji Ozawa, Kawasaki (JP); Katsuhiro Ikegami, Kawasaki (JP)

(73) Assignee: Komatsu Ltd. (JP)

( * ) Notice: Subject to any disclaimer, the term of this patent is extended or adjusted under 35 U.S.C. 154(b) by 1012 days.

(21) Appl. No.: 10/227,198

(22) Filed: Aug. 26, 2002

(65) Prior Publication Data

US 2003/0038196 A1 Feb. 27, 2003

(30) Foreign Application Priority Data

Aug. 27, 2001 (JP) ..... 2001-256598
Jan. 31, 2002 (JP) ..... 2002-024800

(51) Int. Cl.
*B02C 25/00* (2006.01)

(52) U.S. Cl. ..... 241/37; 241/189.1

(58) Field of Classification Search ..... 241/37, 241/36, 189.1

See application file for complete search history.

(56) References Cited

U.S. PATENT DOCUMENTS 5,226,604 A 7/1993 Seiffert et al.
5,713,527 A 2/1998 Hemesath et al.
5,718,389 A 2/1998 Finken et al.

FOREIGN PATENT DOCUMENTS

| | | |
|---|---|---|
| EP | 0 391 096 A2 | 10/1990 |
| EP | 1 287 894 A2 | 3/2003 |
| JP | 02-293058 | 12/1990 |
| JP | 08-266921 | 10/1996 |
| JP | 2002-346410 | 12/2002 |
| JP | 2003-38968 A | 2/2003 |

OTHER PUBLICATIONS

EPO Search Report Apr. 16, 2004.
Guntermann, P., Automatisierungs-und Rationalisierungsmoglichkeiten mit Hazemag-Prallmuhlen, Aufbereitungs Technik, et al, vol. 36, Nr. 12, pp. 578-580.
Japanese Office Action dated May 22, 2007 in Prioirty Application No. 2002-024800.

*Primary Examiner*—Mark Rosenbaum
(74) *Attorney, Agent, or Firm*—Rader Fishman & Grauer PLLC; Ronald P. Kananen

(57) ABSTRACT

In an impact crusher, a rise of an advancing-retracting portion (65) of a gap adjuster (60) caused when a rebound plate (33) touches a rotor (32) or the rotation amount of the rotor (32) is detected to determine a zero-point position of the rebound plate (33) is determined based on the detected result, so that the zero-point position can be securely determined since it is not necessary to touch and vibrate the rebound plate with the rotor rotating at a high speed, and since the rebound plate (33) is not vibrated, the zero-point position can be securely determined without being influenced by the abrasion of the rebound plate (33) and the impact plate (322), thereby accurately adjusting gap (C).

6 Claims, 12 Drawing Sheets

60
64
694
ON
33
32
C
A

65
OFF
322
321

693
OFF
OFF THEN STOP
324

ON

ON
Ss

CONTROL METHOD OF A GAP ADJUSTER OF IMPACT CRUSHER AND A GAP ADJUSTER

BACKGROUND OF THE INVENTION

1. Field of the Invention

The present invention relates to a control method of a gap adjuster of an impact crusher and a gap adjuster. More specifically, it relates to a control method of a gap adjuster and a gap adjuster provided on an impact crusher including a rotor having an impact body, a rebound plate spaced apart from a rotation locus of the tip end of the impact body, and a case for the rotor and the rebound plate to be attached.

2. Description of Related Art

Conventionally, it is known to crush an object such as great mass of concrete and asphalt taken out from demolition site of a building and a quarry and natural stone such as andesite with an impact crusher.

Such impact crusher crushes the object by hitting the object with an impact plate (impact body) of a revolving rotor and by colliding the object hit by the impact body with a rebound plate. At this time, since the size of the object (the size of the object after being crushed) is determined by the gap between the rotation locus of the impact plate and the rebound plate, the gap has to be accurately adjusted and maintained by moving the rebound plate in order to obtain the object of a predetermined size.

For adjusting the gap, in a method disclosed in Japanese Patent Laid-Open Publication No. Hei8-266921, a rebound plate is brought into contact with an impact plate, the contact position being set as a zero-point position of the rebound plate, and the rebound plate is moved back by a predetermined distance with a hydraulic cylinder, thereby automatically adjusting the gap relative to the impact plate.

However, though the rebound plate can be seamlessly and continuously moved when the rebound plate is moved by the hydraulic cylinder as in the above method, it is difficult to minutely move the rebound plate or securely stop at a desired position while moving, so that accurate movement by a desired movement distance cannot be conducted. Accordingly, the gap between the rebound plate and the impact plate cannot be accurately adjusted, and gap accuracy is deteriorated.

Further, according to the above method, when the rebound plate is adjusted to zero-point position, the rebound plate is brought closer to the rotor while rotating the rotor at a high speed before bringing the rebound plate into contact with the impact plate, where the magnitude of vibration of the rebound plate periodically generated by the contact is detected. When the magnitude of the vibration reaches a predetermined vibration limit, the position of the rebound plate is determined as the zero-point position.

However, since the rebound plate is vibrated by the rotation of the rotor while determining the zero-point position, it is vague which position during vibration should be determined as the zero-point position, so that it is difficult to instantly determine accurate zero-point position.

Further, since the magnitude of the vibration of the rebound plate greatly differs according to abrasion of the rebound plate and the impact plate, the zero-point position is shifted on account of the abrasion of the rebound plate and the impact plate when the magnitude of the vibration is always compared with the same vibration limit, so that the zero-point position cannot be accurately determined. Considering the fact that abrasion changes on account of various factors, it is virtually impossible to set the vibration limit in accordance with abrasion.

Accordingly, since the gap is adjusted while determination of the zero-point position is inaccurately conducted, the gap cannot be accurately adjusted.

SUMMARY OF THE INVENTION

An object of the present invention is to provide a control method of a gap adjuster of an impact crusher and a gap adjuster capable of accurately adjusting the gap between the rotation locus of the tip end of the impact body and the rebound plate.

A control method of a gap adjuster of an impact crusher according to an aspect of the present invention includes the steps of: inputting a desired gap amount between a rotation locus of a tip end of an impact portion of a rotor and a rebound plate; moving the rebound plate toward the rotor using a mechanical moving mechanism; determining a zero-point position of the rebound plate based on interference between the rebound plate and the rotation locus of the tip end of the impact portion; moving the rebound plate to be away from the zero-point position using the mechanical moving mechanism; and stopping the movement of the rebound plate in a direction away from the zero-point position when an actual gap amount of the rebound plate reaches the desired gap amount.

Incidentally, in the following explanation, the "rotation locus of the tip end of the impact portion" is sometimes simplified as "impact portion".

According to the control method of the gap adjuster, in order to adjust the gap between the rebound plate and the impact portion, it is only necessary to input the desired gap amount in adjusting the gap between the rebound plate and the impact portion, and the rebound plate at the zero-point position automatically moves until the desired gap amount is reached. At this time, since the rebound plate is moved, not by a conventional hydraulic cylinder, but by a mechanical moving mechanism such as screw-type and rack-and-pinion type, the movement amount can be minutely controlled based on screw pitch and circle pitch and the rebound plate can be stopped at any desired position. Accordingly, the rebound plate securely moves from the zero-point position by the desired gap amount, thereby accurately conducting the gap adjustment.

Since the gap can be accurately adjusted, final object (crushed object) of a desired grain size can be securely obtained.

A control method of a gap adjuster of an impact crusher according to another aspect of the present invention includes the steps of: moving a rebound plate toward a rotor; detecting initial contact of the rebound plate with the rotor based on a rise of a rebound plate support supporting the rebound plate; after detecting the rise of the rebound plate support, moving the rebound plate to be away from the rotor; rotating the rotor to detect whether the rotor again touches the rebound plate or not based on the rise of the rebound plate support; repeating the movement of the rebound plate to be away from the rotor and the rotation of the rotor until the rise of the rebound plate support is not detected; and determining the position of the rebound plate when it is judged that the rise of the rebound plate support is not detected as a zero-point position.

According to the above control method of the gap adjuster, the rebound plate is brought into contact with the rotor and the rise of the rebound plate support caused by the contact is detected, based on which the zero-point position of the rebound plate is detected. Accordingly, it is not necessary to bring the rotor into contact with the rebound plate while rotating at high-speed, so that the zero-point position can be securely determined. Further, since the rebound plate is not vibrated, the zero-point position can be determined without being influenced by the abrasion of the rebound plate and the impact portion. Accordingly, by securely adjusting the zero-point position and moving the rebound plate from the zero-point position, the gap between the rebound plate and the impact portion can be accurately adjusted.

A control method of a gap adjuster of an impact crusher according to still another aspect of the present invention includes the steps of: rotating the rotor; detecting initial contact of the rebound plate with the rotor when the rotation amount of the rotor becomes less than a predetermined rotation amount; after detecting that the rotation amount of the rotor does not exceed the predetermined rotation amount, moving the rebound plate to be away from the rotor; rotating the rotor to detect whether the rotor again touches the rebound plate or not by judging that the rotation amount of the rotor does not exceed the predetermined rotation amount; repeating the movement of the rebound plate to be away from the rotor and the rotation of the rotor until the rotation of the rotor exceeds the predetermined rotation amount; and determining the position of the rebound plate when the rotation of the rotor exceeds the predetermined rotation amount as a zero-point position.

According to thus arranged control method of the gap adjuster, the rotor is brought into contact with the rebound plate and the rotation amount of the rotor restricted by the contact is detected, based on which the zero-point position of the rebound plate is determined. Accordingly, it is not necessary to determine the zero-point position based on the vibration of the rebound plate, so that the gap between the rebound plate and the impact portion can be rapidly and accurately adjusted.

A control method of a gap adjuster of an impact crusher according to further aspect of the present invention includes the steps of: moving a rebound plate toward the rotor; detecting initial contact of the rebound plate with the rotor based on a rise of a rebound plate support supporting the rebound plate; after detecting the rise of the rebound plate support, moving the rebound plate to be away from the rotor; rotating the rotor to detect whether the rotor again touches the rebound plate or not by judging that the rotation amount of the rotor does not exceed a predetermined rotation amount; repeating the movement of the rebound plate to be away from the rotor and the rotation of the rotor until the rotation of the rotor exceeds the predetermined rotation amount; and determining the position of the rebound plate when the rotation of the rotor exceeds the predetermined rotation amount as a zero-point position.

According to the above control method, the zero-point position of the rebound plate can be securely set by combining the above-described rise-detection and rotation-detection, and following effect can be obtained.

In the above-described rise-detection method, whether the rebound plate has reached to the zero-point position or not is detected based on the rise of the rebound plate support caused by the contact of the rotor with the rebound plate. However, when the rotor enters into the rebound plate, the rebound plate support may not be raised in spite of the mutual contact. In this case, it is unclear whether the rebound plate support is not raised because the rotor enteres thereto or because the rotor is not in contact with the rebound plate, thereby causing trouble in determining the zero-point position.

On the other hand, in the above-described rotation-amount detection method, the initial contact of the rebound plate with the rotor when the rotor is rotated toward the rebound plate is detected by the rotation amount of the rotor of less than a predetermined rotation amount. However, it is likely that the rotation amount of the rotor exceeds the predetermined rotation amount before the rotor is in contact with the rebound plate according to the position of the rebound plate in starting rotation of the rotor, thereby causing detection error.

By combining the rise-detection and the rotation-amount detection as in the above aspect of the present invention, the initial contact between the rebound plate and the rotor is detected based on the rise of the rebound plate support, so that the detection error likely to be caused in the rotation-amount detection can be securely prevented. Further, since whether the rebound plate has reached the zero-point position or not is detected based on the rotation amount of the rotor, even when the rotor enters into the rebound plate, the entering can be securely recognized based on the rotation amount of the rotor, so that the trouble for determining the zero-point position can be avoided. Accordingly, the zero-point position can be further accurately determined.

A control method of a gap adjuster of an impact crusher according to still further aspect of the present invention includes the steps of: recognizing a current gap between a rotation locus of a tip end of an impact portion of a rotor and a rebound plate in advance; inputting a desired movement amount of the rebound plate relative to the rotation locus of the tip end of the impact portion; moving the rebound plate toward or away from the rotor; and stopping the rebound plate when an actual movement amount of the rebound plate reaches the desired movement amount.

According to the above control method of gap adjuster, the current gap amount is recognized in advance and the rebound plate is moved by the desired movement amount relative to the current position to adjust the gap. Accordingly, there is no need for colliding the rebound plate with the impact portion to vibrate, thereby accurately conducting the gap adjustment.

In the above, the rebound plate may preferably be moved using a mechanical moving mechanism.

Accordingly, since the rebound plate is moved not by a hydraulic cylinder as in a conventional arrangement but by a mechanical moving mechanism, the rebound plate can be accurately moved by the desired movement amount, thereby further improving the gap adjustment accuracy.

A gap adjuster of an impact crusher according to still further aspect of the present invention, the impact crusher having: a rotor having an impact portion; a rebound plate spaced apart from a rotation locus of a tip end of the impact portion by a gap; and a case for the rotor and the rebound plate to be attached, has: a rebound-plate-side component attached to the rebound plate; a case-side component screwed to or meshed with the rebound-plate-side component to be attached to the case; a rebound plate drive for rotating the case-side component to move the rebound plate; a movement sensor for detecting the movement amount of the rebound plate; a set value inputting device for setting and inputting a desired movement amount or a desired gap amount of the rebound plate; and a controller for controlling the rebound plate drive based on a detection signal from the movement sensor and the desired movement amount or the gap amount inputted by the set value inputting device.

According to the above gap adjuster, the above-described mechanically-driven control method of the present invention is implemented to attain an object of the present invention.

Specifically, following steps of: inputting a desired gap amount between the rotation locus of the tip end of the impact portion of the rotor and the rebound plate; rotating the case-side component to move the rebound plate toward the rotor; determining a zero-point position of the rebound plate based on interference between the rebound plate and the rotation locus of the tip end of the impact portion; rotating the case-side component to move the rebound plate to be away from the zero-point position using the mechanical moving mechanism; detecting an actual movement amount of the rebound plate in the direction to be moved away from the rotor; and comparing the actual movement amount of the rebound plate and the gap amount, are conducted.

Further, according to the gap adjuster, desired movement amount is inputted instead of inputting the desired gap amount, and the rebound plate is moved not from the zero-point position but from the current rebound plate position to achieve the above-described control method in accordance with the movement amount.

A gap adjuster of an impact crusher according to still further aspect of the present invention, the impact crusher having: a rotor having an impact portion; a rotor drive for rotating the rotor; and a rebound plate spaced apart from a rotation locus of a tip end of the impact portion by a gap, the gap adjuster has: a rebound plate support for movably supporting the rebound plate; a rebound plate drive for driving the rebound plate support to move the rebound plate; a movement sensor for detecting the movement amount of the rebound plate; a rise sensor for detecting the rise of the rebound plate support when the rebound plate touches the rotor; a set value inputting device for setting and inputting a desired gap amount between the rebound plate and the impact portion; and a controller for controlling the rebound plate drive and the rotor drive based on a detection signal from the movement sensor and the desired gap amount inputted by the set value inputting device.

According to the above gap adjuster, the above-described rise-detection control method of the present invention is implemented by conducting the following steps.

Specifically, following steps of: inputting a desired gap amount between the rebound plate and the rotation locus of the tip end of the impact portion; driving the rebound plate support to move the rebound plate toward the rotor; detecting initial contact of the rebound plate with the rotor based on the rise of the rebound plate support supporting the rebound plate; after detecting the rise of the rebound plate support, moving the rebound plate to be away from the rotor by a predetermined amount; rotating the rotor to detect whether the rotor again touches the rebound plate or not based on the rise of the rebound plate support; repeating the movement of the rebound plate to be away from the rotor by the predetermined amount and the rotation of the rotor until the rise of the rebound plate support is not detected; and determining the position of the rebound plate when it is judged that the rise of the rebound plate support is not detected as a zero-point position, are conducted.

A gap adjuster of an impact crusher according to still further aspect of the present invention, the impact crusher having: a rotor having an impact portion; a rotor drive for rotating the rotor; and a rebound plate spaced apart from a rotation locus of a tip end of the impact portion by a gap, the gap adjuster has: a rebound plate support for movably supporting the rebound plate; a rebound plate drive for driving the rebound plate support to move the rebound plate; a movement sensor for detecting the movement amount of the rebound plate; a rotation sensor for detecting the rotation amount of the rotor; a set value inputting device for setting and inputting a desired gap amount between the rebound plate and the impact portion; and a controller for controlling the rebound plate drive and the rotor drive based on a detection signal from the movement sensor and the desired gap amount inputted by the set value inputting device.

According to the above gap adjuster, following steps are conducted to achieve the rotation-detection control method, thereby achieving an object of the present invention.

Specifically, the following steps of: inputting a desired gap amount between the rebound plate and the rotation locus of the tip end of the impact portion; rotating the rotor; detecting initial contact of the rebound plate with the rotor when the rotation amount of the rotor becomes less than a predetermined rotation amount; after detecting that the rotation amount of the rotor does not exceed the predetermined rotation amount, moving the rebound plate to be away from the rotor by a predetermined amount; rotating the rotor to detect whether the rotor again touches the rebound plate or not by judging that the rotation amount of the rotor does not exceed the predetermined rotation amount; repeating the movement of the rebound plate to be away from the rotor by the predetermined amount and the rotation of the rotor until the rotation of the rotor exceeds the predetermined rotation amount; and determining the position of the rebound plate when the rotation of the rotor exceeds the predetermined rotation amount as a zero-point position, are conducted.

A gap adjuster of an impact crusher according to still further aspect of the present invention, the impact crusher having: a rotor having an impact portion; a rotor drive for rotating the rotor; and a rebound plate spaced apart from a rotation locus of a tip end of the impact portion by a gap, the gap adjuster has: a rebound plate support for movably supporting the rebound plate; a rebound plate drive for driving the rebound plate support to move the rebound plate; a movement sensor for detecting the movement amount of the rebound plate; a rise sensor for detecting the rise of the rebound plate support when the rebound plate touches the rotor; a rotation sensor for detecting the rotation amount of the rotor; a set value inputting device for setting and inputting a desired gap amount between the rebound plate and the impact portion; and a controller for controlling the rebound plate drive and the rotor drive based on a detection signal from the rise sensor, a detection signal from the rotation sensor, and the desired gap amount inputted by the set value inputting device.

According to the above gap adjuster, following steps are conducted to achieve the control method combining the rise-detection and the rotation-detection, thereby achieving an object of the present invention.

Specifically, following steps of: inputting a desired gap amount between the rebound plate and the rotation locus of the tip end of the impact portion; moving a rebound plate toward the rotor by driving the rebound plate support; detecting initial contact of the rebound plate with the rotor based on the rise of the rebound plate support supporting the rebound plate; after detecting the rise of the rebound plate support, moving the rebound plate to be away from the rotor by a predetermined amount; rotating the rotor to detect whether the rotor again touches the rebound plate or not by judging that the rotation amount of the rotor does not exceed a predetermined rotation amount; repeating the movement of the rebound plate to be away from the rotor by the predetermined amount and the rotation of the rotor until the rotation of the rotor exceeds the predetermined rotation amount; and determining the position of the rebound plate when the rotation of the rotor exceeds the predetermined rotation amount as a zero-point position, are conducted.

BRIEF DESCRIPTION OF THE DRAWINGS

FIG. 8 are illustrations for explaining full-auto mode during gap adjustment, in which

DETAILED DESCRIPTION OF PREFERRED EMBODIMENT(S)

Preferred embodiments of the present invention will be described below with reference to attached drawings.

First Embodiment

Figure 1:
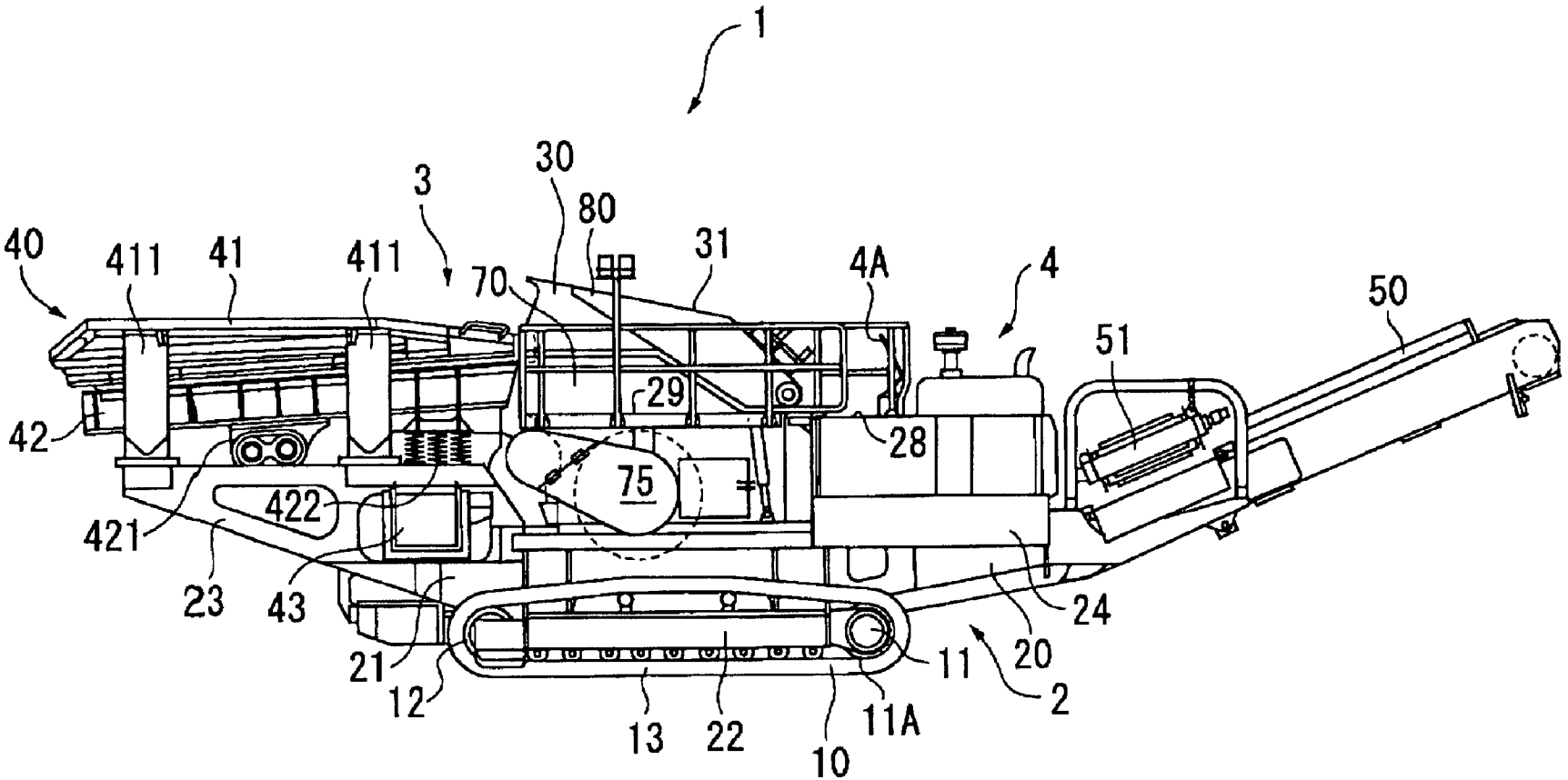
FIG. 1 is a side elevational view showing a mobile crushing machine installed with an impact crusher according to first embodiment of the present invention.
Figure 2:
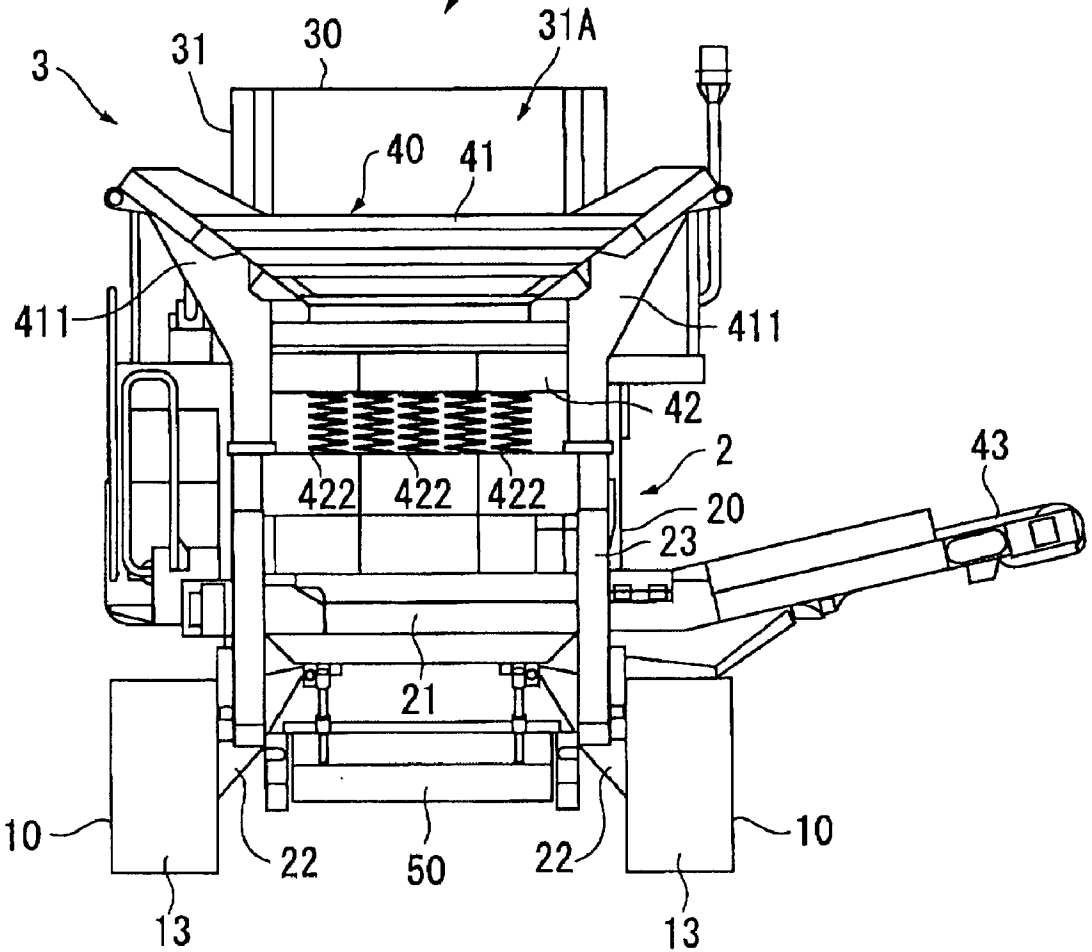
FIG. 2 is an illustration of the mobile crushing machine seen from a side from which the object is to be charged.
Figure 3:
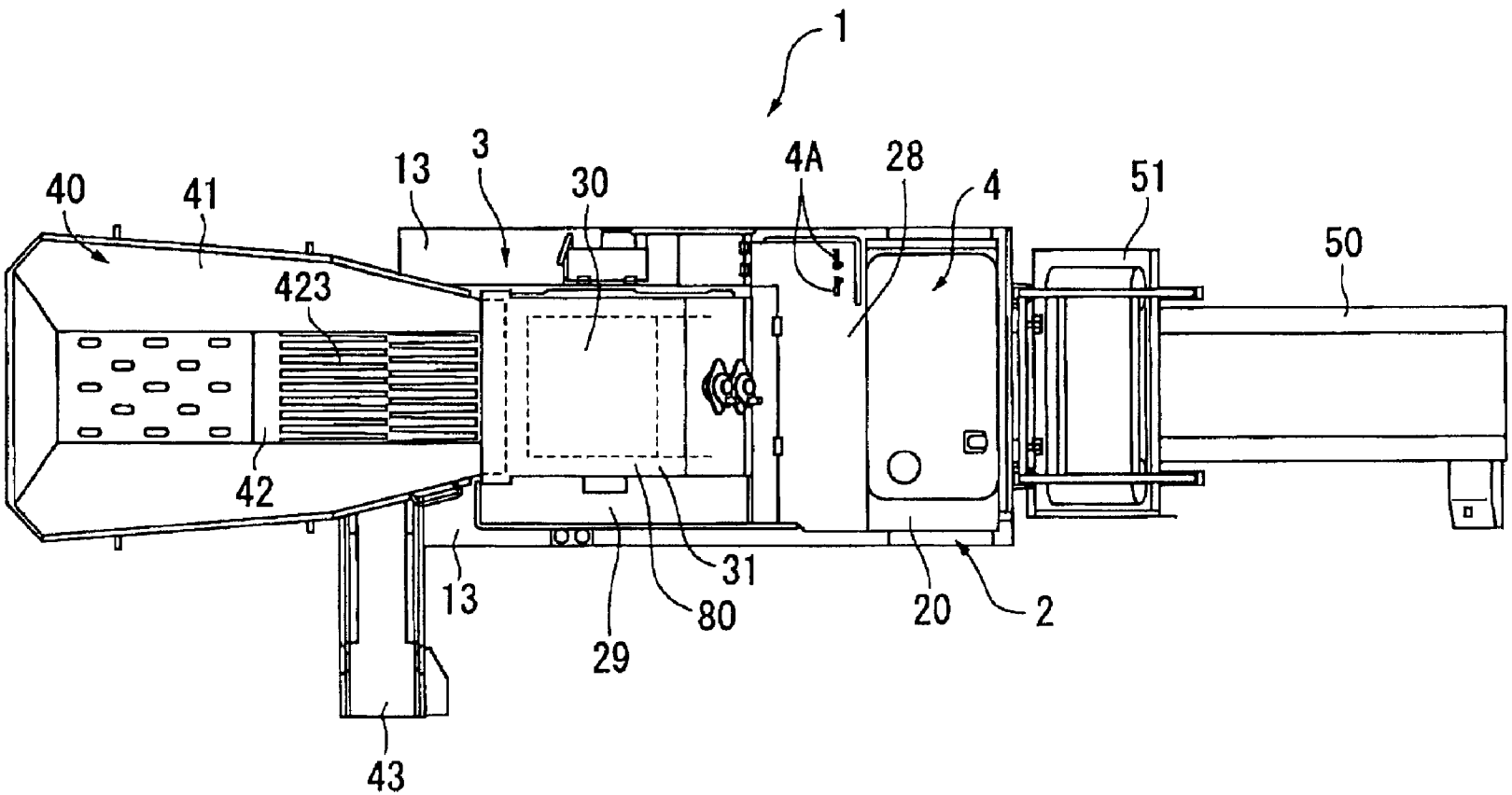
FIG. 3 is a plan view showing the mobile crushing machine.

FIG. 1 is a side elevational view showing an entire mobile crushing machine 1 according to first embodiment, FIG. 2 is an illustration showing the mobile crushing machine 1 seen from a side from which an object is to be charged, and FIG. 3 is a plan view of the mobile crushing machine 1.

[Outline of Mobile Crushing Machine]

As shown in FIGS. 1 to 3, the mobile crushing machine 1 has a base 2 onto which a work machine 3 and a power section 4 are mounted.

The base 2 has a pair of crawler type running sections 10 for driving in work site, and a frame 20 with the running section 10 being attached and the work machine 3 and the power section 4 being mounted.

The work machine 3 has an impact crusher (referred to as a crusher hereinafter) 30 installed approximately at the center of the base 2, an object feeding portion 40 for feeding an object to the crusher 30 and a discharge belt conveyer 50 for discharging the crushed object.

The power section 4 is a power source of the running section 10, the crusher 30, the discharge belt conveyer 50 etc., which includes an engine (not shown), a hydraulic pump 6 (FIG. 7) driven by the engine, a main valve 8 (FIG. 7) for controlling hydraulic oil from the hydraulic pump 6 etc. A drive lever 4A for driving and rotating the mobile crushing machine 1 and an upper control box (not shown) with indicators for driving being disposed thereon are provided on the upper side of the power section 4, and a side control box (not shown) for operating the work machine 3 is provided adjacent to the side of the power section 4.

The crusher 30 side of the power section 4 is a first working floor 28 formed by an upper surface of the power section 4, where various works such as operation of the drive lever 4A, maintenance and inspection of the crusher 30 are conducted.

In the following explanation, the discharge belt conveyer 50 side of the mobile crushing machine 1 is referred to as "front side" (right side in FIG. 1), the object feeding portion 40 side is referred to as "rear side" (left side in FIG. 1) and the side orthogonal with the "front" and "rear" sides (right and left direction in FIG. 2) is referred to as "lateral" sides for the sake of convenience.

The running section 10 is provided on a crawler frame 22 forming a part of the frame 20 and has a hydraulic motor 11 on the front side of the crawler frame 22. An endless track crawler belt 13 driven by the hydraulic motor 11 is wound around a sprocket 11A of the hydraulic motor 11 and an idler 12 on the other side. The hydraulic motor 11 is driven by the hydraulic pump of the power section 4 through a control valve (not shown).

The frame 20 has a main frame 21 on which the crawler frame 22 is attached as well as the pair of the crawler frames 22. A flat crusher mount 211 is provided on a part of the main frame 21, where the crusher 30 is mounted. A hopper frame 23 for the object feeder 40 to be mounted and an engine frame 24 for the power section 40 to be mounted are fixed on the main frame 21.

Figure 4:
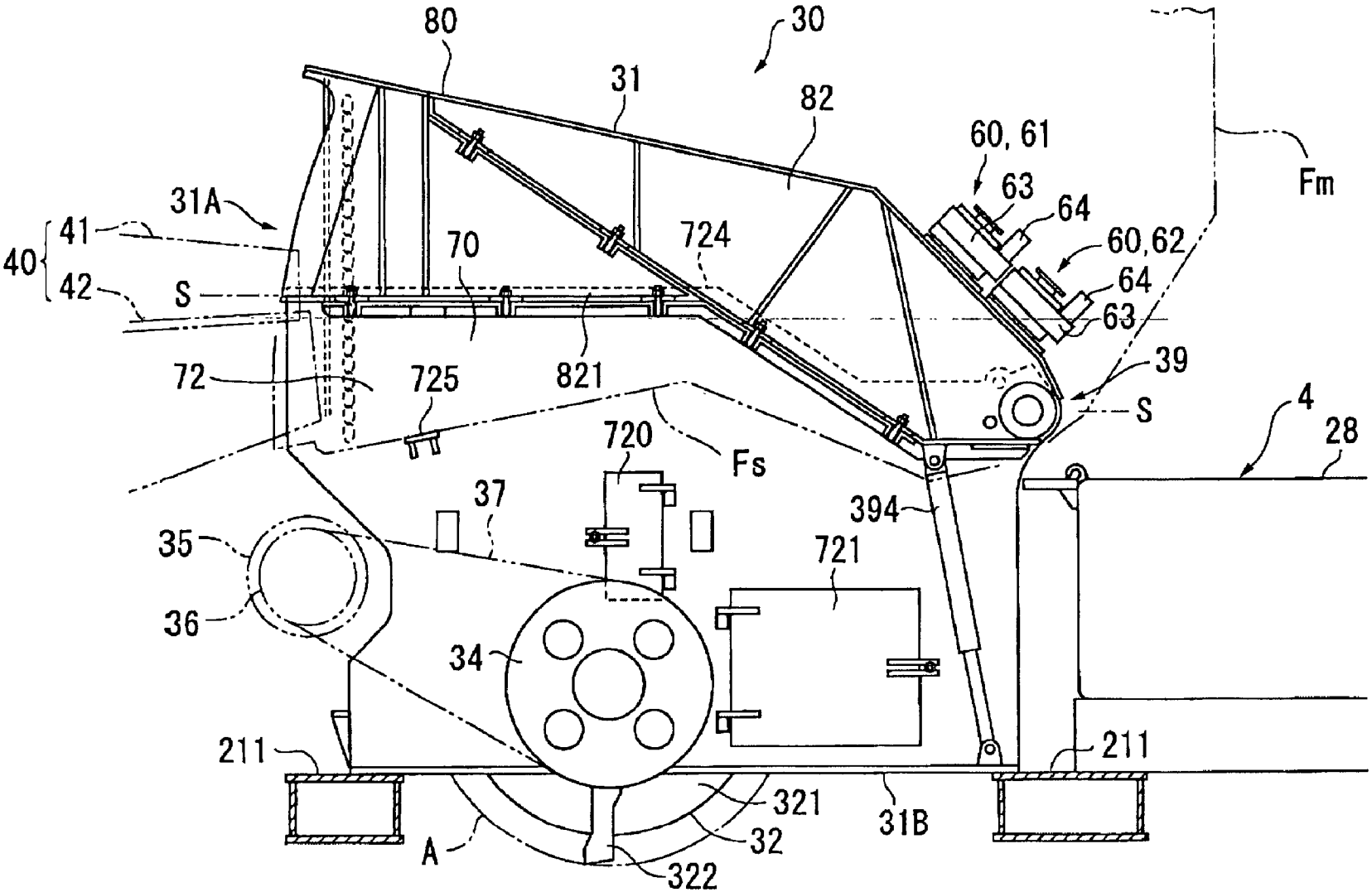
FIG. 4 is a side elevational view showing the impact crusher.
Figure 5:
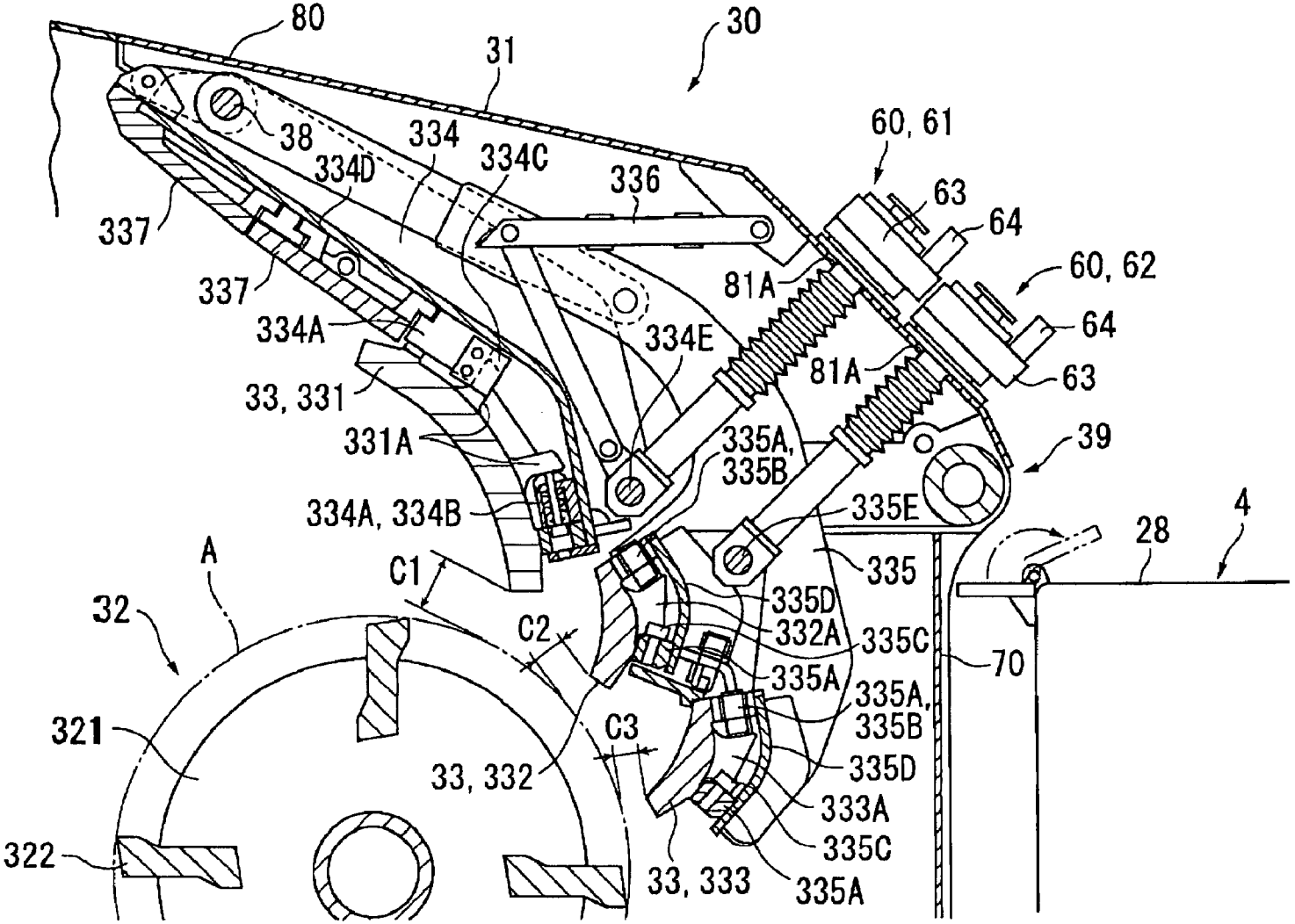
FIG. 5 is a vertical cross section showing a part of the internal structure of the impact crusher.

As shown in FIGS. 4 and 5, the crusher 30 has a case 31 having a charging hole 31A of the object to be crushed, in which a rotor 32 having a rotor body 321 and an impact plate 322 and rebound plates 33 spaced apart from a rotation locus A of the tip end of the impact plate 322 by gaps C1, C2 and C3 are disposed.

In the crusher 30, the object charged from the charging hole 31A is hit by the rotating impact plate 322 and collided with the rebound plate 33 after being hit and scattered to be crushed, which falls on the discharge belt conveyer 50 from a discharge hole The rotor 32 is disposed in the fixed case 70 and, as shown in FIG. 5, the rebound plate 33 is attached to the movable case 80.

The fixed case 70 is a box with the entire upper side area being opened and having the discharge hole 31B being located on the bottom side thereof, both of the sides of the fixed case 70 in lateral direction being fixed-case side portion 72. Respective fixed-case side portions 72 have two access doors 720 and 721 (only one of the fixed-case portion being illustrated), the access doors 720 and 721 being opened to check the inside of the case 31 and whether the object is stuffed in the discharge hole 31B on the bottom side of the case 31. The size and number of the access door may be determined as desired.

On the other hand, the movable case 80 is a lid-shaped body covering the upper opening of the fixed case 70, the peripheral end on the rear side of the movable case 80 forming a part of the charging hole 31A. Both sides of the movable case 80 in lateral direction are movable-case side portion 82. The respective movable-case side portions 82 are located outside relative to the fixed-case side portion 72 of the fixed case 70, and lower periphery 821 of the fixed-case side portion 82 swallows upper periphery 724 as the upper side of the fixed-case side portion 72. In other words, in the case 31 of the present embodiment, the upper periphery 724 and the lower periphery 821 overlap in lateral direction and the parting line S-S of the fixed case 70 and the movable case 80 are formed along the overlapped portion.

The fixed case 70 and the movable case 80 are connected by a turn mechanism 39 provided on an upper portion opposite to the charging hole 31A, so that the movable case 80 turns upward to be opened relative to the fixed case 70 and sinks deeply downward until the lower periphery 821 touches a contact portion 725 around the turning axis of the turn mechanism 39. In other words, the condition shown in solid line in FIG. 4 is working position of the movable case 80 at which crushing work is conducted. The condition shown in double-dotted line where the movable case 80 is opened is movable case maintenance position Fm, at which the rebound plate 33 (331, 332, 333) is exposed to be reversed and exchanged by opening the movable case 80. The condition where the movable case 80 is deeply sunk is a transport position Fs of the movable case 80, at which the total height of the case 31 is reduced to match the mobile crushing machine 1 with height restriction in transportation by a trailer.

The fixed case 70 and the movable case 80 are connected by the hydraulic cylinder 31B on the bottom side of the case 31 to be discharged.

The object feeding portion 40 has a hopper 41 for the object to be loaded, and a grizzly feeder 42 disposed beneath the hopper 41 with a slight gap retained.

The hopper 41 is supported on the hopper frame 23 of the frame 20 by supports 411 provided on four corners thereof and greatly widened upward.

The feeder 42 is a vibration-type having a vibrator 421 driven by the hydraulic power from the power section 4, which is supported on the hopper frame 23 through a plurality of helical springs 422 and is vibrated within the gap while avoiding contact with the hopper 41 to feed the object toward the crusher 30. The end of the hopper 41 and the feeder 42 are, as shown in double-dotted line in FIG. 4A, inserted in the charging hole 31A of the crusher 30, so that the object is securely charged into the crusher 30.

The feeder 42 not only feeds the object to the crusher 30 but also selects small objects unnecessary to be crushed by a comb-shaped grizzly 423 (FIG. 3) to throw them downward. The sifted objects falls on another belt conveyer 43 shown in FIGS. 1 to 3 to be discharged or falls on the discharge belt conveyer 50 by switching a damper (not shown) to be discharged together with the crushed objects.

The discharge belt conveyer 50 has a base end in feeding direction (left side in FIG. 1) located beneath the frame 20 to transport the crushed object discharged from the discharge hole 31B of the crusher 30 or the discharged objects from the grizzly 423 (the same as the charged object) toward a distal side (right side in FIG. 1). The discharge belt conveyer 50 is of triple-bending structure, where discharge height on the distal side is sufficiently secured so that work can be securely conducted without employing second belt conveyer. The discharge belt conveyer 50 is also driven by the hydraulic power from the power section 4.

A magnetic separator 51 is disposed in around the middle of the discharge belt conveyer 50 supported by the frame 20, where metallic material such as rebar obtained in crushing concrete mass is magnetically absorbed by a permanent magnet to be discharged by an annexed belt conveyer.

[Crusher]

The crusher 30 will be described below in detail with reference to FIGS. 4 and 5.

The case 31 of the crusher 30 is a separate type having a fixed case 70 fixed to the frame 20 (FIG. 1) and a movable case 80 attached to the upper side of the fixed case 70. 394 slightly closer to the charging hole 31A relative to the turn mechanism 39. The hydraulic cylinder 394 is actuated in turning the movable case 80 to assist turning movement of the movable case 80 of great weight. The hydraulic cylinder 394 is disposed so that cylinder thereof is located on the upper side and rod thereof is located on the lower side to prevent dust etc. from depositing on the rod-side end of the cylinder and improve durability of packing etc.

The rotor 32 of the crusher 30 is supported by a bearing (not shown) on the outside of the case 31 and has a pulley 34 on an end thereof. A hydraulic motor (rotor drive) 35 shown in double-dotted line is disposed on the outside of the case 31 and a V-belt 37 is wound around a pulley 36 of the hydraulic motor 35 and the pulley 34. In other words, the rotor 32 is rotated by the hydraulic motor 35 through the V-belt 37. The hydraulic motor 35 is driven by hydraulic power from the hydraulic pump of the power section 4 through the control valve 8A in the main valve 8.

The impact plate 322 of the rotor 32 is continuously provided along the lateral direction (axis line direction of the rotor body 321) in a range slightly narrower than the width of the case 31, the impact plate 322 projecting in plural (four in the present embodiment) at equal interval along the circumference of the rotor body 321. The impact plate 322 is capable of attachment and detachment and is reversed or exchanged with a new impact plate in accordance with abrasion thereof.

Next, in FIG. 5, the rebound plate 33 of the crusher 30 includes a first rebound plate 331, a second rebound plate 332 and a third rebound plate 333 arranged sequentially along the rotation direction of the rotor 32 from the charging hole 31A (FIG. 4) side.

The first rebound plate 331 is greater than the other plates, so as to securely receive bigger object just charged in. A pair of engaging projections 331A are provided on the backside of the first rebound plate 331, the engaging projections 331A being engaged between engagement portions 334A on the lower side of a first arm 334 and being held by a screw fixing component 334B provided on one of the engagement portion 334A and a stop 334C provided on an end in lateral direction. The first rebound plate 331 are closely arranged in plural in lateral direction, which can respectively be inserted and pulled out in lateral direction by releasing the fixing component 334B and the stop 334C, so that the rebound plates 331 are reversed or exchanged with new rebound plate in accordance with abrasion thereof.

The second and the third rebound plates 332 and 333 have the same shape, which are held between engagement portions 335A provided on the lower portion of a second arm 335 by a fixing component 335B and a stop 335C through engaging projections 332A and 333A on the backside. The second and the third rebound plates 332 and 333 can also be inserted into and pulled out from the second arm 335 to be exchanged in accordance with abrasion thereof. Since the abrasion during crushing process equally occurs on the entire side of the second and the third rebound plates 332 and 333 of moderate size, the second rebound plate 332 and 333 are not used in reversed manner. However, the second and the third rebound plates 332 and 333 may be arranged in reversible manner as in the first rebound plate 331.

The first arms 334 and the second arms 335 are arranged in pair and in parallel spaced apart in lateral direction, the respective arms being integrally connected with connection plates 334D and 335D and connection bars 334E and 335E. The respective second arms 335 are located inside the pair of the first arm 334. Both of the upper side of the first and the second arms 334 and 335 are supported in upward direction in the case 31. On the other hand, the lower side of the first and the second arms 334 and 335 are suspended by an expandable first and second gap adjuster 60 (61, 62) attached to the connection bars 334E and 335E.

The first and the second gap adjuster 61 and 62 are expanded and contracted by driving the hydraulic motor (rebound plate drive) 64 of the drive mechanism 63 on the upper end, where, as described below in detail, a screw-type mechanical moving mechanism 69 (see FIGS. 6A and 6B) having nut-shaped component and bolt-shaped component. The expansion and contraction of the first and the second gap adjusters 61 and 62 turns the first and the second arms 334 and 335 around the turning shaft 38, thereby adjusting the dimension of respective gaps C1, C2 and C3 between the rotation locus A on the tip end of the impact plate 322 and the first to third rebound plates 331 to 333.

Incidentally, the second gap adjuster 62 adjusts the gap C3 at the third rebound plate 333 between the second and the third rebound plates 332 and 333. This is because the adjustment of the gap C3 is important for determining final grain size of the object. The gap C2 at the second rebound plate 332 provided on the common second arm 335 is automatically adjusted by adjusting the gap C3 in accordance with relationship of mutual position of the second and the third rebound plates 332 and 333.

A bending restriction link 336 for restricting rotation in expanding direction of the first gap adjuster 61 is provided on the first arm 334. The restriction link 336 prevents excessive stretch of the first gap adjuster 61 to restrict turning amount of the first arm 334. On the other hand, the turning amount of the second arm 335 is restricted by contact with the first arm 334.

On the first arm 334, a liner 337 capable of inserting and pulling out is attached above the first rebound plate 331 in order to protect the first arm 334 from the crushed object etc.

In the crusher 30, a second working floor 29 is provided on an upper side of a pulley cover 75 of one of the fixed-case side portions 72 of the fixed case 70 at the same height as the first working floor 28. The second working floor 29 is constructed by a scaffolding board component extending in front and rear direction of the fixed-case side portion 72 and is fixed to the fixed-case side portion 72 with a bolt etc. A front end of the second working floor 29 is adjacent to the first working floor 28, the respective working floors 28 and 29 being formed along angled two edges of substantially flat tetragon crusher 30, so that worker can easily move between the respective working floors 28 and 29.

When the movable case 80 is at the maintenance position, the crusher 30 can be easily accessed from the second working floor 29 striding over the fixed case 70. Further, the hopper 41 can be accessed by striding over the hopper 41 and the front of the feeder 42 (on the side of the charging hole 31A) to move easily onto the feeder 42.

[Detailed Description of Gap Adjuster]

The gap adjuster 60 will be described in detail with reference to FIG. 6A Incidentally, both of the first and the second gap adjusters 61 and 62 have the same construction, and will be collectively described below as the gap adjuster 60.

Figure 6A:
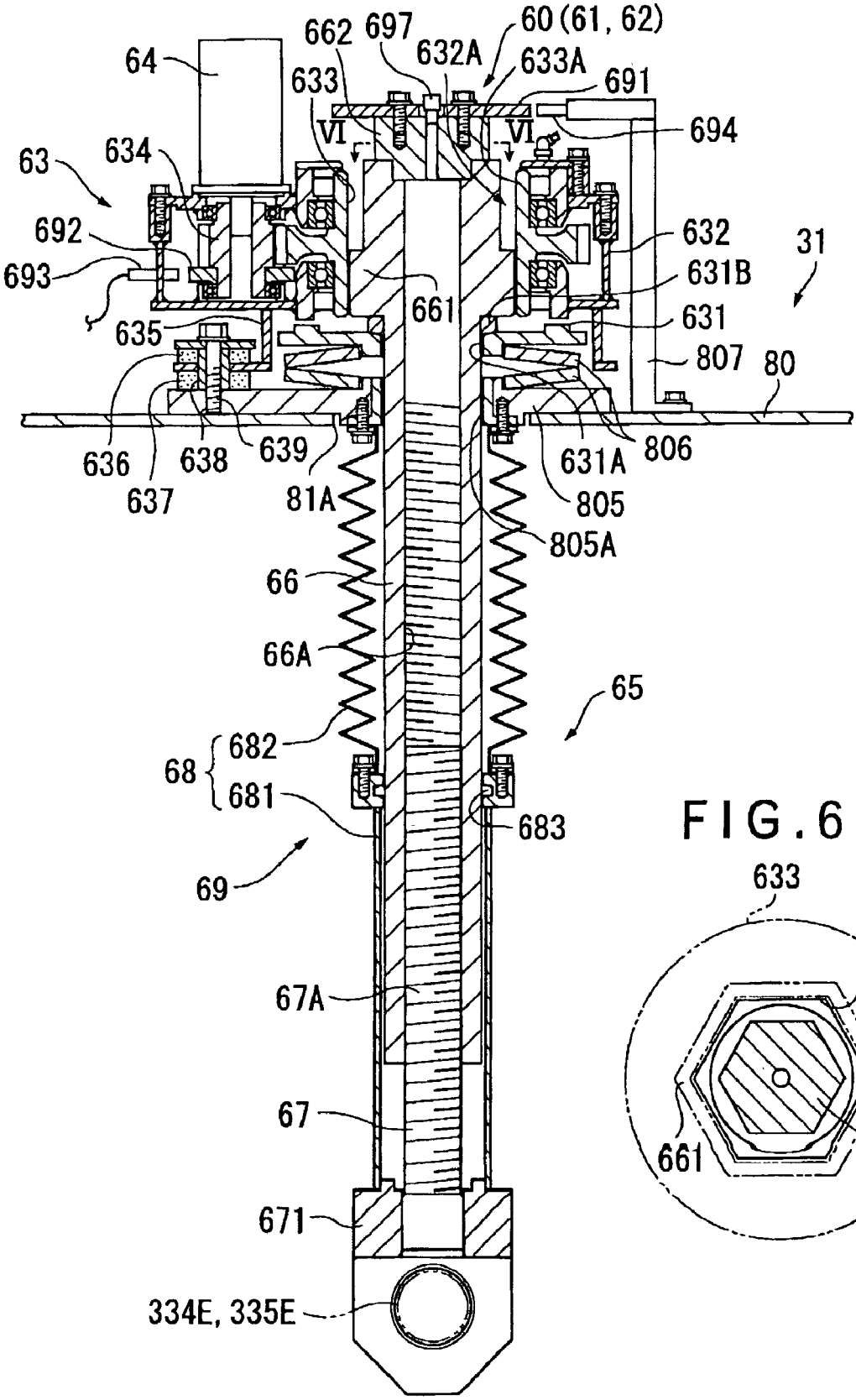
FIG. 6A is a vertical cross section showing a gap adjuster of the impact crusher.

In FIGS. 5 and 6A, the gap adjuster 60 has the drive mechanism 63 and a rod-shaped advancing-retracting portion 65 driven by the drive mechanism 63.

The drive mechanism 63 is attached on a mount base 805 fixed on the upper side of the movable case 80 by bolt through a pair of vertically superposed coned disc springs 806 and has a spring-receiving plate 631 on the coned disc spring 806. A through-hole 631A coaxial with through-holes 81A and 805A drilled on the movable case 80 and the mount base 805 is provided on the spring-receiving plate 631. The advancing-retracting portion (rebound plate support) 65 is inserted into the through-holes 81A, 805A and 631A.

Figure 6B:
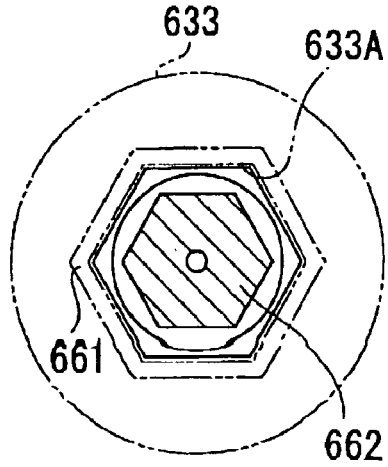
FIG. 6B is a cross section taken along VI-VI line of FIG. 6A.

The drive mechanism 63 has an exterior case 632 provided on the spring-receiving plate 631. An accommodating portion 632A for accommodating the upper end of the advancing-retracting portion 65 is provided on the exterior case 632. A cylindrical gear 633 having a hollow portion 633A of hexagonal horizontal cross section as shown in double-dotted line in FIG. 6B is rotatably disposed in the accommodating portion 632A. As shown in the horizontal cross section, a flat hexagonal fitting portion 661 provided on the advancing-retracting portion 65 is fitted into the hollow portion 633A of the cylindrical gear 633, so that the advancing-retracting portion 65 is rotated together with the rotation of the cylindrical gear 633.

Figure 7:
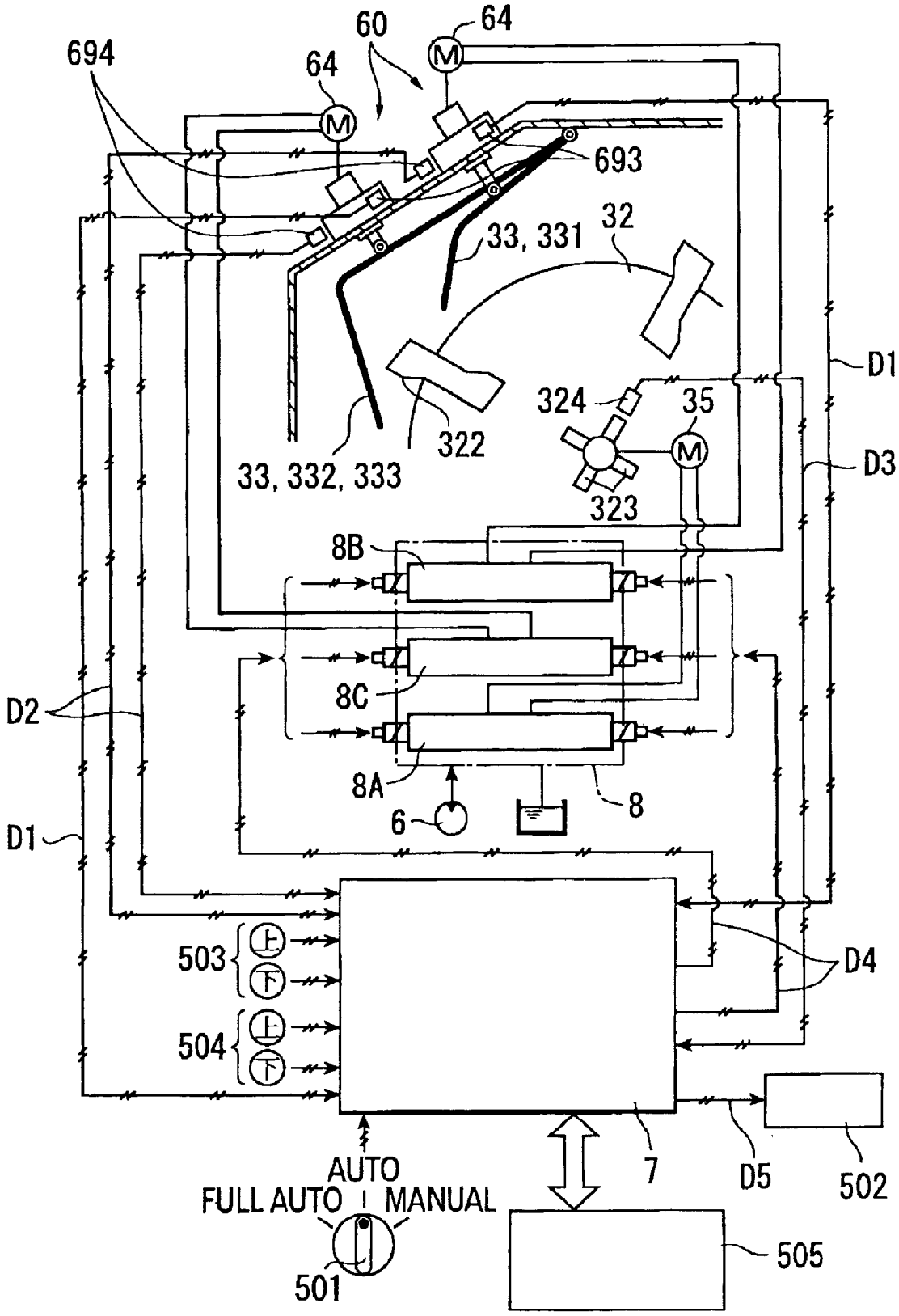
FIG. 7 is a block diagram of the impact crusher.

The cylindrical gear 633 meshes with a gear 634 of smaller diameter and the gear 634 is connected to the rotation shaft of the hydraulic motor 64. Accordingly, the advancing-retracting portion 65 is rotated by the hydraulic motor 64. At this time, the rotation of the hydraulic motor 64 is decelerated between the gear 634 and the cylindrical gear 633 to be transmitted to the advancing-retracting portion 65. The meshed portion between the cylindrical gear 633 and the gear 634 are lubricated by lubricant oil injected into the exterior case 632. Further, as shown in FIG. 7, the hydraulic motor 64 is driven by hydraulic power from the hydraulic pump 6 supplied through respective control valves 8B and 8C in the main valve 8.

The exterior case 62 is attached to the mount base 805, i.e. the movable case 80, through a lower end flange of a cylinder 635 provided on the lower side thereof. The flange of the cylinder 635 is sandwiched by a pair of upper and lower rubber materials 636 and 637, and the flange is attached by a sleeve 638 and a bolt 639 penetrating the flange and the rubber materials 636 and 637.

Incidentally, though only one of the attachment portions having the rubber materials 636 and 637 is shown in FIG. 6A, the attachment portion is actually provided on an opposing position around rotation center of the cylindrical gear 633 (advancing-retracting portion 65), so that the drive mechanism 63 is attached to the movable case 80 at two positions.

Vertical section of the cylinder 635 in FIG. 6A is sized to cover the circumference of the coned disc spring 806 and the spring-receiving plate 631 to prevent dust etc from falling on the components.

On the other hand, the advancing-retracting portion 65 has a nut 66 (case-side component) attached on the movable case 80 side, and a bolt 67 (rebound-plate-side component) with lower end thereof being attached to the connection bars 334E and 335E of the rebound plate 33, a screw 67A carved on the bolt 67 being screwed to a screw 66A carved on the inside of the nut 66.

The fitting portion 661 is provided on the upper side of the nut 66 and, as shown in FIG. 6B, a manipulating portion 662 of flat hexagonal shape slightly smaller than the fitting portion 661 is attached thereon by welding separate component etc. The manipulating portion 662 is capable of receiving hand tool such as a box wrench by detaching a detection plate 691 fixed by bolt on the upper side thereof, so that the nut 66 can be manually rotated. At the center of the manipulating portion 662, a grease nipple 697 is provided so that grease can be fed to the screw 66A of the nut 66 etc.

The bolt 67 is attached to the connection bars 334E and 335E through a joint component 671 on the lower side thereof, and a cover component 68 for covering the portion inserted into the case 31 of the advancing-retracting portion 65 is provided between the joint component 671 and the above mount base 805.

The cover component 68 is constructed by connecting a lower side cylindrical portion 681 fixed to the joint component 671 and an upper bellows-shaped expandable portion 682 fixed to the mount base 805. The upper end of the cylindrical portion 681 advancing and retracting together with the bolt 67 is in close contact with the outer circumference of the nut 66 through a ring-shaped sealing material 683. The length of the cylindrical portion 681 and the bolt 67 is approximately equal, so that the sealing material 683 is always in close contact with the outer circumference of the nut 66 within the advanceable and retractable range (stroke) of the bolt 67, thereby preventing invasion of dust and water into the cylindrical portion 681.

The advancing-retracting portion 65 is inserted into the through-holes 81A, 805A and 631A of the movable case 80 and the drive mechanism 63, so that self weight thereof is received by the spring-receiving plate 631 through an oilless ring (nylon pad) 631B. Accordingly, the advancing-retracting portion 65 is not fixed at any part in insertion direction thereof, so that the entire advancing-retracting portion 65 rises in a manner for the fitting portion 661 to be away from the spring-receiving plate 631 at a time of malfunction when a big object collides with the rebound plate 33 with great force or an object is stuffed between the rebound plate 33 and the impact plate 322.

At this time, since the movement locus of the connection bars 334E and 334E at the tip end of the advancing-retracting portion 65 draws an arc around the turning shaft 38 (FIG. 5), the advancing-retracting portion 65 rises upward being slightly obliquely inclined around a fulcrum of the contact portion with the through-hole 805A of the mount base 805. When the advancing-retracting portion 65 rises while being inclined, the cylindrical gear 633 and the exterior case 632 also incline, however, the inclination is absorbed by elastic deformation of the rubber materials 636 and 637.

The advancing-retracting portion 65 after eliminating the rise moves back to downward on account of self-weight, weight of the rebound plate 33 and the first and the second arms 334 and 335, the impact etc. at the time being absorbed by the pair of coned springs 806.

The rise of the advancing-retracting portion 65 is also caused in adjusting the gaps C1 to C3, which will be described below.

According to the above-described gap adjuster 60, when the nut 66 of the advancing-retracting portion 65 is rotated by the hydraulic motor 64, the bolt 67 attached to the rebound plate 33 seamlessly advances and retracts without rotating in accordance with rotating amount and rotating direction of the nut 66. The advancement and retraction of the bolt 67 moves (turns) the rebound plate 33 through the first and the second arms 334 and 335, thereby seamlessly adjusting the gaps C1 to C3 between the rebound plate 33 and the impact plate 322.

[Arrangement of Gap Adjustment]

Next, a control method of the gap adjuster 60 in adjusting the gaps C1 to C3 will be described below.

The crusher 30 of the present embodiment has (1) full-auto mode, (2) automatic mode, and (3) manual mode for gap adjustment. Details of the respective modes will be described later, and the arrangement necessary for controlling the gap adjuster 60 will be described below in detail with reference to FIGS. 6A and 7.

In FIGS. 6A and 7, the gear 634 constituting the drive mechanism 63 of the gap adjuster 60 is provided with a disc-shaped detection disc 692 having a plurality of notches on the circumference thereof. A rebound-plate-side rotation sensor (movement amount detecting means) 693 that detects the notch of the rotating detection disc 692 and outputs a detection signal D1 to a controller 7 each time the notch is detected is provided on the exterior case 632.

In the gap adjuster 60, the position of the detection plate 691 provided on the upper end of the bolt 67 is detected by a rise sensor (rise sensing means) 694 attached through a bracket 807, which detects the rise of the advancing-retracting portion 65. Detection signal D2 from the rise sensor 694 is also outputted to the controller 7.

A projection (dog) 323 located corresponding to the impact plate 322 is provided on the rotation shaft of the rotor 32 and a rotor-side rotation sensor (rotation amount detecting means) 324 fixed on the case 31 or bearing etc. by an appropriate fixing means is provided adjacent to the projection 323. The rotor-side rotation sensor 324 detects the projection 323 rotated together with the rotor 32 to output a detection signal D3 each time the projection 323 is sensed.

The controller 7 has a CPU, a memory, program (software) stored in the memory for adjusting gap, a pulse counter, a timer, etc.

The controller 7 is connected with a changeover switch 501 for switching the gap-adjusting mode into respective "full-auto", "auto" and "manual" modes, an alarm 502 constructed by a buzzer, light etc. for indicating malfunction during gap adjustment, a first manual switch 503 for vertically moving the first rebound plate 331 in the manual mode, a second manual switch 504 for vertically moving the second and the third rebound plates 332 and 333 in the manual mode and an input panel 505 attached with a liquid crystal panel where value can be inputted by operating ten-keys.

Incidentally, upward movement of the rebound plate 33 is the movement away from the rotor 32 and downward movement is the movement toward the rotor 32.

The controller 7 executes the program based on the detection signals D1 to D3 from the respective sensors 324, 693 and 694 and the signal from the connected changeover switch 501, the first and the second manual switches 503 and 504 and the input panel 505, conduct switching operation by outputting a control signal D4 to the respective control valves 8A to 8C, controls the hydraulic motor 35 on the rotor 32 side and the hydraulic motor 64 of the respective gap adjuster 60, and actuates the alarm 502 by outputting a malfunction signal D5 when malfunction is detected.

The controller 7 and the respective sensors 324, 693 and 694 constitute a part of the gap adjuster 60 according to the present invention.

Though not illustrated in detail, the respective control valves 8A to 8C of the main valve 8 are valves of four-port and three-position, which has a solenoid actuated by the control signal D4 from the controller 7 for switching position.

[Gap Adjustment: Full-Auto Mode]

Next, the control method of the gap adjuster 60 while adjusting gap in the full-auto mode will be described below with reference to FIGS. 7, 8, 9 and 10. Since the adjustment of the gap C1 between the first rebound body 331 and the impact plate 332 and the adjustment of the gap C3 (C2) between the third rebound plate 333 (second rebound plate 332) and the impact plates 332 are essentially equal, the first to the third rebound plate 331 to 333 are collectively represented as rebound plate 33 and the gaps C1 to C3 are represented as gap C. The same also applies in the explanation of the automatic mode and manual mode described later.

In the full-auto mode, the impact plate 33 is automatically adjusted to the zero-point position where the rebound plate 33 interferes with the rotation locus A of the tip end of the impact plate 322 and is automatically moved away from the zero-point position by a predetermined gap. Accordingly, the full-auto mode accompanies the zero-point position determination.

The full-auto mode gap adjustment is conducted when totally new impact plate 322 and rebound plate 33 are attached as in the case of immediately after the crusher 30 is shipped from factory, when it is necessary to re-adjust the zero-point position of the rebound plate 33 when one or both of the impact plate 322 and the rebound plate 33 are worn and exchanged, or when the zero-point position is shifted on account of abrasion of the impact plate 322 and the rebound plate 33 thus increasing the size of the obtained object.

In order to conduct the gap adjustment by the full-auto mode, the changeover switch 501 is switched to the "full-auto mode". Then, the program corresponding to the full-auto mode is called from the memory and executed in accordance with respective steps (ST) shown in FIGS. 9 and 10.

Figures 8A, 8B, 8C, 8D, 8E:
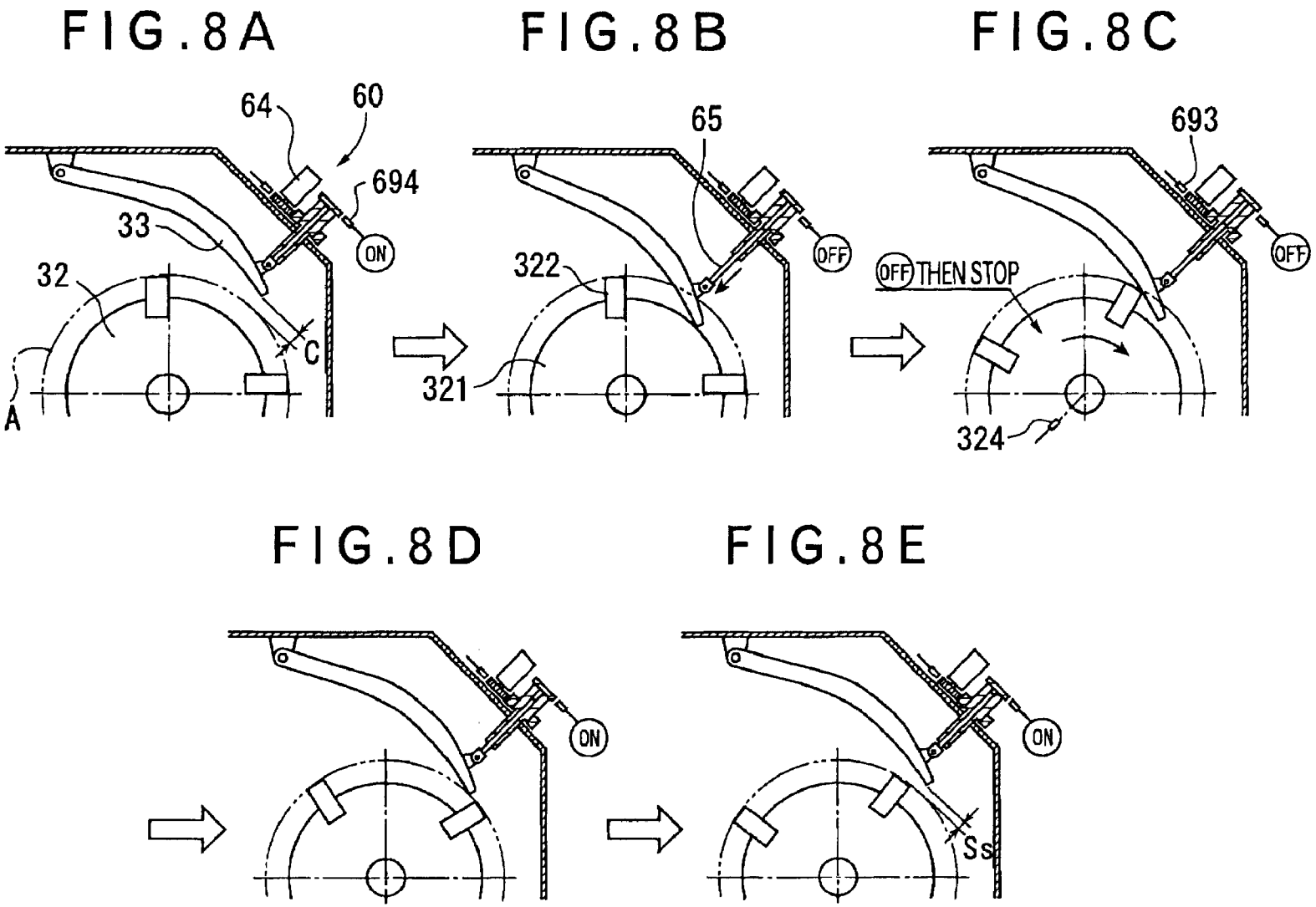
FIG. 8A shows a condition before adjustment.
FIG. 8B shows lowering operation.
FIG. 8C shows repetition of routine.
FIG. 8D shows zero-point position and FIG. 8E shows gap adjustment, respectively.
Figure 9:
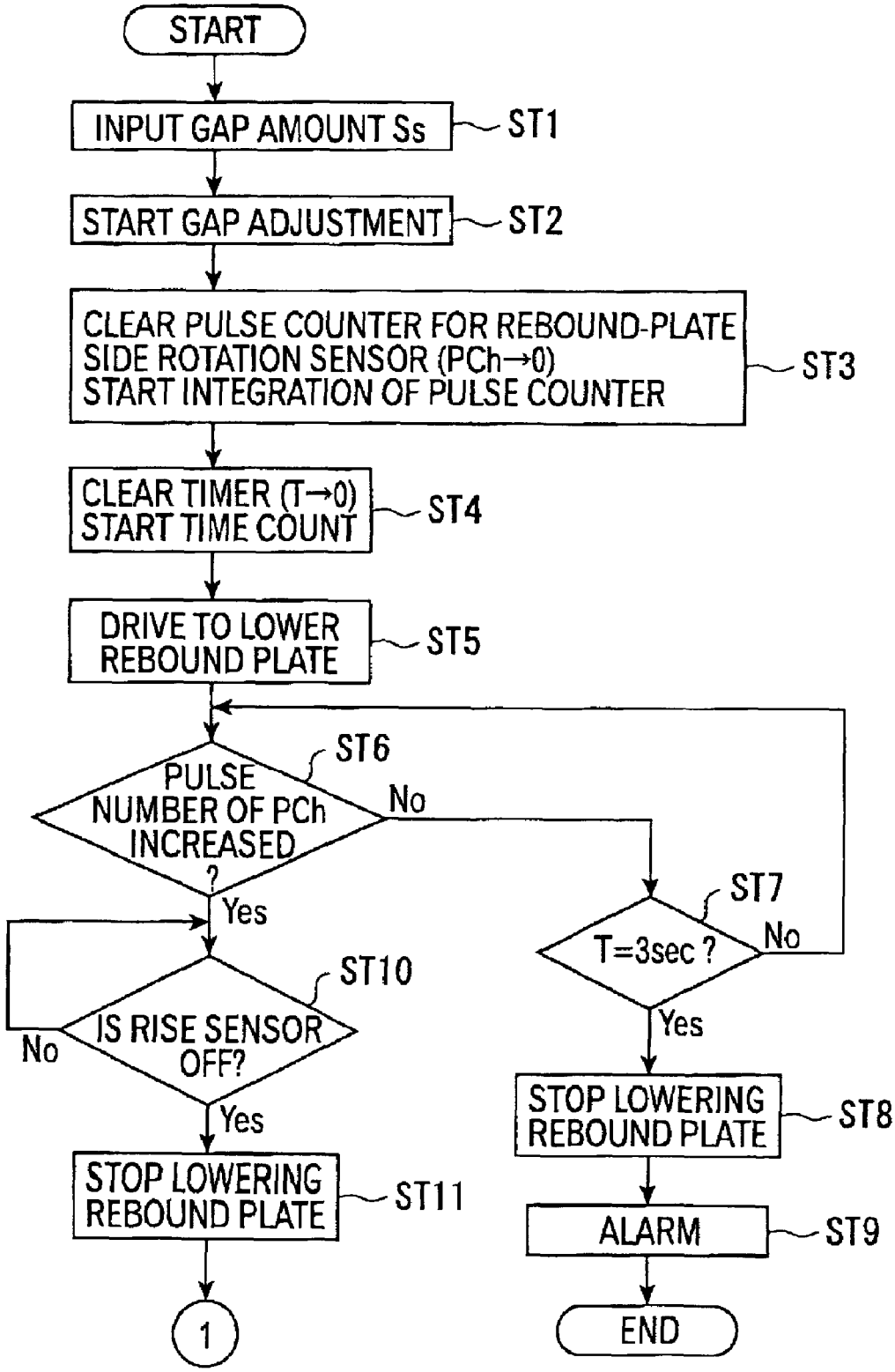
FIG. 9 is a flow chart showing the full-auto mode.

ST1 in FIG. 9: Initially, the distance by which the rebound plate 33 is moved away from the zero-point position (rotation locus A of the tip end of the impact plate 322) is inputted as a desired gap amount Ss. The gap amount Ss is inputted by operating ten-key in accordance with instructions displayed on the input panel 505. The gap amount Ss is inputted by the unit of millimeter (mm). At this stage, as shown in FIG. 8(A), the rotor 32 is stopped at a position and "pre-adjustment" gap C is retained between the rotation locus A and the rebound plate 33.

ST2: Next, gap adjustment is started by pressing execute button (not shown) provided on the controller 7 etc. When the execute button is not pressed, the inputted gap amount Ss is stored in a predetermined memory.

ST3: When the gap adjustment is started, the controller 7 clears a pulse counter PCh for the rebound-plate-side rotation sensor 693 and subsequently starts integration of the pulse number by the pulse counter PCh.

ST4: The controller 7 also clears the timer T in the controller 7 and let the timer to count time.

ST5: Thereafter, the controller 7 outputs the control signal D4 to the control valves 8B and 8C to switch to the communicating position and drives the hydraulic motor 64 of the gap adjuster 60 in a direction for the rebound plate 33 to be lowered.

ST6: Then, the controller 7 checks whether the pulse number of the pulse counter PCh is increased (increase toward minus side). When the pulse number is increased, the controller judges that the rebound plate 33 is normally lowered toward the rotor 32.

ST7: On the other hand, when the pulse number is not increased, the hydraulic motor 64 is continuously driven until the time T reaches three seconds. However, the interval setting of the timer T is not restricted to three seconds, but may be changed in actual implementation.

ST8: When the pulse number is not increased after three seconds, the controller 7 judges that the rebound plate 33 cannot be further lowered since the advancing-retracting portion 65 of the gap adjuster 60 is extended to the maximum or the rebound plate 33 has already been in contact with the rotor 32, and switches the control valves 8B and 8C to stop the hydraulic motor 64 to suspend lowering the rebound plate 33.

ST9: Then, the controller 7 outputs the malfunction signal D5 to the alarm 502 to notify an operator that the rebound plate 33 cannot be lowered.

ST10: When the rebound plate 33 continues to be lowered normally, the rebound plate 33 touches, for instance, the rotor body 322 of the rotor 32 as shown in FIG. 8(B). When the rebound plate 33 is further lowered after the contact, since the bolt 67 of the advancing-retracting portion 65 shown in FIG. 6A is not further advanced, the nut 66 moves upward.

Accordingly, in the ST10, whether the nut 66 has moved upward or not is checked. When the detection plate 691 is out of detection range on account of upward movement and the rise sensor 694 becomes "OFF", the controller 7 judges that the rebound plate 33 is in contact with the rotor 32.

ST11: After it is judged that the rebound plate 33 touches the rotor 32, the controller 7 switches the control valves 8B and 8C to a shut position to stop the hydraulic motor 64 to suspend lowering the rebound plate 33.

Figure 10:
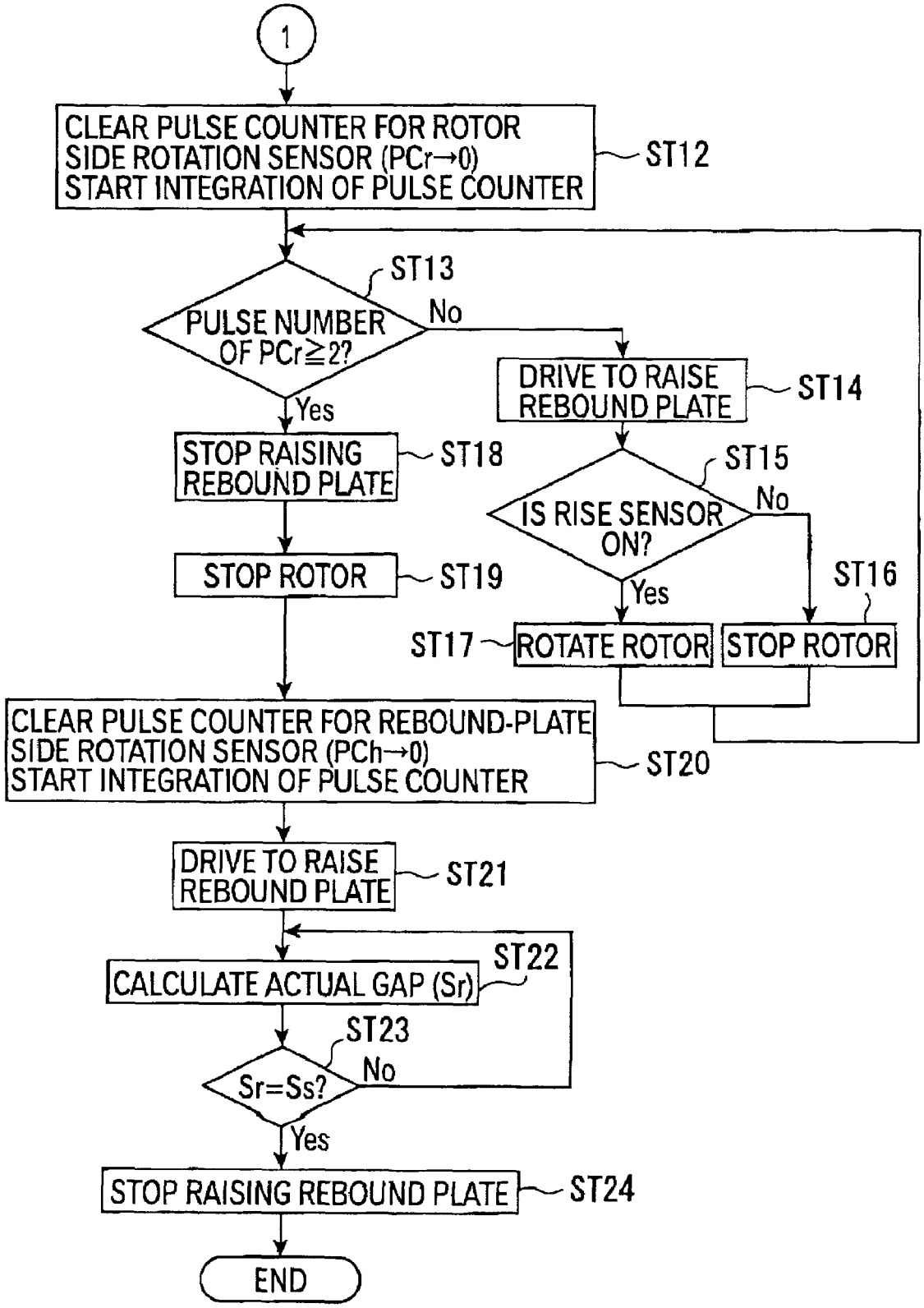
FIG. 10 is a continuation of the flow chart of the full-auto mode.

ST12 in FIG. 10: Next, the controller 7 clears the pulse counter PCr for the rotor-side rotation sensor 324 and, subsequently, starts integration by the pulse counter PCr.

ST13: Then, the controller 7 checks whether the pulse counter PCr exceeds "two", i.e. two projections 323 (FIG. 7) have passed the rotor-side rotation sensor 324 or not. In other words, the controller 7 checks whether the rotation of the rotor 32 exceeds one fourth thereof and the impact plate 322 has passed the rebound plate 33 at least once or not. Since the rotor 32 is not rotated, the process naturally advances to ST14.

Incidentally, the rotor 32 is rotated until two projections 323 are detected because the impact plate 322 can go without being in contact with (passing) the rebound plate 33 only after one projection 323 has passed. This is because the rotor-side rotation sensor 324 does not necessarily detect the projection 323 at the contact position between the impact plate 322 and the rebound plate 33 (see position relationship between the rebound plate 33 and the rotor-side rotation sensor 324 in FIG. 7).

ST14: The controller 7 switches the control valves 8B and 8C to a communicating position different from the previous position (in ST5), to drive the hydraulic motor 64 in a direction for raising the rebound plate 33 is raised.

ST15: When the lowering movement of the rebound plate is stopped in ST11 (FIG. 9), since the nut 66 is slightly raised and the rise sensor 694 is in "OFF" state, the nut 66 is moved downward before the rebound plate 33 is moved away from the contact position with the rotor 32 when the hydraulic motor 64 is driven in a direction for the rebound plate 33 to be raised in ST14, and the nut 66 is returned to initial position before being raised. When the hydraulic motor 64 is further driven, the bolt 67 is retracted to move the rebound plate 33 away from the contact position with the rotor 32.

Accordingly, in ST15, the controller 7 checks the output signal from the rise sensor 694 to monitor whether the nut 66 returns to the initial position before being raised.

ST16: When the nut 66 is not lowered, the rotor 32 is stopped (since the rotor 32 is not rotated, the suspension of the rotor 32 is maintained) and ST13 to ST16 are repeated until the nut 66 is lowered.

ST17: When the rise sensor 694 is in "ON" state when the nut 66 is lowered, the controller 7 switches the control valve 8A to a communicating position to rotate the rotor 32 while moving the rebound plate 33 upward. The rotation of the rotor 32 is continued, as described in ST13, until the rotation from starting the rotation exceeds one fourth thereof, during which ST13 to ST15 and ST17 are repeated.

Incidentally, when the rotor 32 is rotated, one impact plate 322 touches the rebound plate 33 until the rotation exceeds one fourth thereof. After the impact plate 322 is in contact with the rebound plate 33, since the rotation speed of the rotor 32 is faster than the speed for raising the rebound plate 33, the impact plate 322 raises the advancing-retracting portion 65 of the gap adjuster while rotating and set the rise sensor 694 in an "OFF" state.

At this time, the process advances from ST15 to ST16 and the controller 7 switches the control valve 8A into a shut position to stop rotation of the rotor 32 (see FIG. 8(C)). Then, the controller 7 again repeats ST13 to ST16.

Accordingly, the routine from ST13 to ST16 and the routine from ST13 to ST15 and ST17 are alternately executed and the rotor 32 is discontinuously rotated while being in substantially close contact with the rebound plate 33, so that the rebound plate 33 is discontinuously raised while being in substantially close contact with the rotor 32.

ST18, ST19: When it is judged that the rotation of the rotor 32 exceeds one fourth in ST13, the controller 7 stops the movement of the rebound plate 33 and the rotation of the rotor 32.

Accordingly, the tip end of the impact plate 322 passes and stops while tracing the circumference of the rebound plate 33. The rebound plate 33 is stopped substantially at the position where the rebound plate 33 starts interference with the rotation locus A of the tip end of the impact plate 322, the controller 7 determining the position of the rebound plate 33 as the zero-point position (see FIG. 8(D)).

Incidentally, since the rotor 32 is necessarily rotated by one fourth, when the impact plate 322 touches the rebound plate 33 immediately after rotating the rotor 32, the impact plate 322 rotates more after releasing the contact with the rebound plate 33 and the rebound plate 33 moves farther upward to be greatly away from the rotation locus A. However, since the movement speed of the rebound plate 33 is very slow as compared to the rotation of the impact plate 322 (rotor 32), the rebound plate 33 is not greatly moved away from the rotation locus A and the accuracy of the zero-point position is scarcely influenced.

ST20: After determining the zero-point position, the controller 7 again clears the pulse counter PCh for the rebound-plate-side rotation sensor 693 and starts integration of the pulse number by the pulse counter.

ST21: Then, the controller 7 drives the hydraulic motor 64 in a direction for the rebound plate 33 is raised to actually raise the rebound plate 33.

ST22: The controller 7 calculates actual gap Sr (mm) relative to the zero-point position caused by the movement of the rebound plate 33 according to the following formula, where the pulse number of the pulse counter PCh is M (pulse), and the moving amount of the rebound plate 33 each time one pulse is counted is N (mm/pulse):

$$Sr=M*N$$

The moving amount N is determined considering decelerating ratio between the cylindrical gear 633 and the gear 634 of the gap adjuster 60, screw pitch of the respective screws 66A and 67A and the arc shape of the actual moving locus of the rebound plate 33.

ST23: Subsequently, the actual gap Sr increasing in accordance with the increase (increase to plus side) in the pulse number of the pulse counter PCh is compared with the desired gap amount Ss set in ST1 and the rebound plate 33 is moved upward until Sr becomes equal to Ss.

ST24: When Sr becomes equal to Ss, the controller 7 stops driving the hydraulic motor 64 to suspend the movement of the rebound plate 33.

According to the above-described ST20 to ST24, the distance between the impact plate 322 and the rebound plate 33 is adjusted to the desired gap Ss (see FIG. 8(E)).

[Gap Adjustment: Automatic Mode]

In the automatic mode, the rebound plate 33 located at an initial position is automatically moved upward or downward by an inputted movement amount to adjust the gap, which is conducted for changing the current gap in order to obtain crushed objects of more desirable grain size.

Specifically, there are varieties in the object to be crushed, e.g. concrete which is fragile and easily crushed into small size, asphalt which has viscosity and is difficult to be crushed in small size and hard natural stone which has no viscosity but is difficult to be crushed. In the impact crusher 30 using impact force for crushing the object, in order to equalize the grain size of the final object, the gap amount between the impact plate 322 and the rebound plate 33 are often changed (slightly widened) in accordance with the type of the object. In other words, the gap is initially adjusted to standard gap by the full-auto mode and the gap is minutely adjusted in accordance with the type of the object by the automatic mode.

Further, when the impact plate 322 and the rebound plate 33 are worn, the gap may be adjusted by the full-auto mode accompanying the determination of the zero-point position or alternatively may be adjusted by the automatic mode instead of the full-auto mode to lower the rebound plate 33 by the abrasion, for instance.

In order to adjust the gap by the automatic mode, the current gap between the rotation locus A of the impact plate 322 and the rebound plate 33 are recognized in advance by manual measurement using gauge etc., and the current gap is widened or reduced. However, the current gap may be recognized not by the gauge but may be assumed based on the grain size of the actually obtained object.

In adjusting the gap by the automatic mode, the changeover switch 501 is switched to "automatic" mode. Then, the program corresponding to the automatic mode is called from the memory and is executed in accordance with respective steps shown in FIG. 11.

Figure 11:
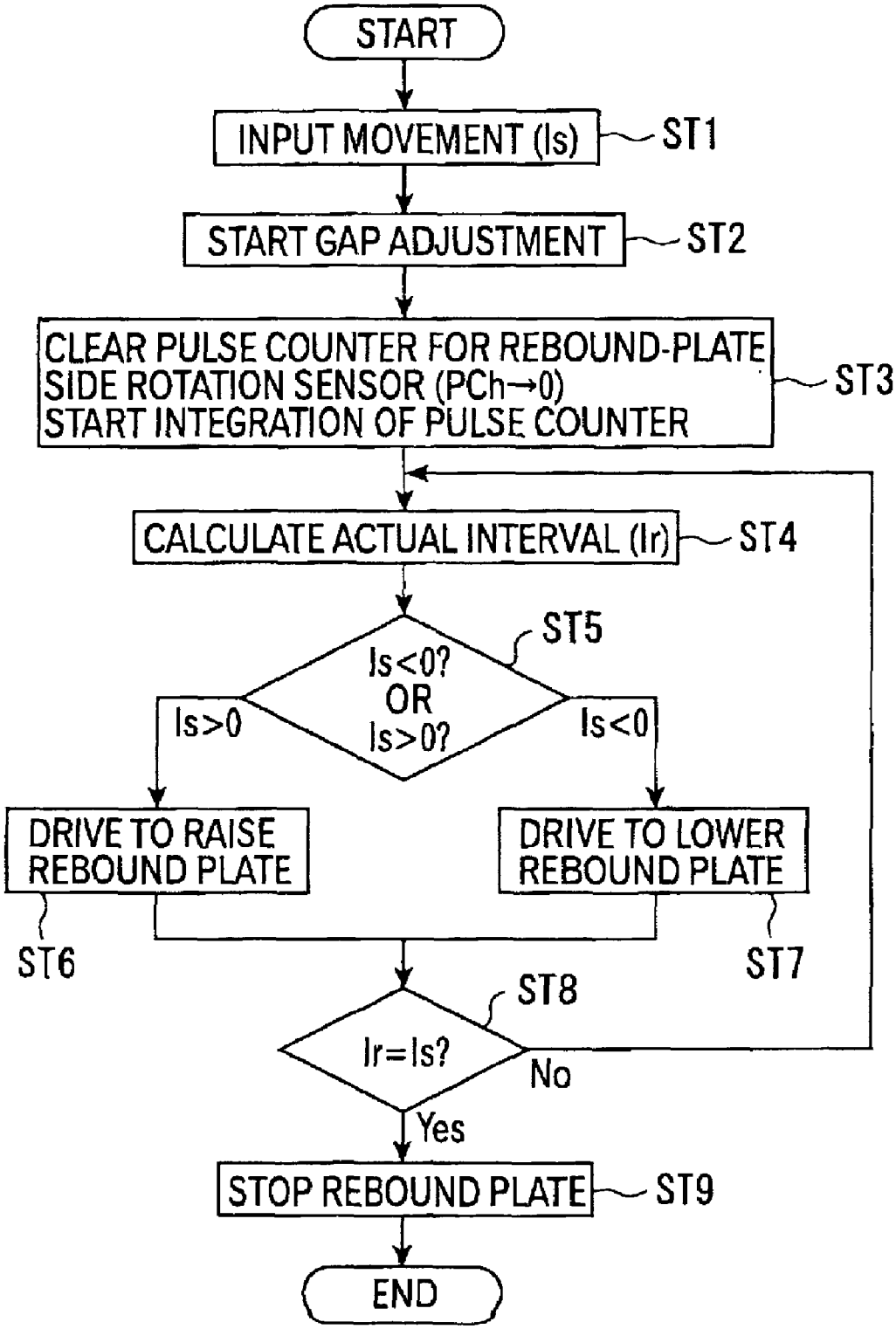
FIG. 11 is a flow chart showing an automatic mode.

ST1 in FIG. 11: Initially, the distance for which the rebound plate 33 is moved from the current position is inputted as a desired movement amount Is from the input panel 505. At this time, in order to move the rebound plate 33 downward, the movement amount Is is inputted in minus setting and, in order to move the rebound plate 33 upward, the movement amount Is is inputted in plus setting.

ST2: Next, gap adjustment is started by pressing execute button (not shown) provided on the controller 7 etc.

ST3: When the gap adjustment is started, the controller 7 clears a pulse counter PCh for the rebound-plate-side rotation sensor 693 and subsequently starts integration of the pulse number by the pulse counter PCh.

ST4: The controller 7 calculates actual movement Ir of the rebound plate 33 based on the pulse number M of the pulse counter PCh and the moving amount N of the rebound plate per one pulse.

ST5: Subsequently, the controller 7 judges whether the inputted desired movement amount Is inputted in ST1 is minus setting or plus setting.

ST6: When the movement amount Is is plus setting, the controller 7 drives the hydraulic motor 64 to raise the rebound plate 33.

ST7: When the movement amount Is is minus setting, the controller 7 drives the hydraulic motor 64 to lower the rebound plate 33.

ST8: Thereafter, the actual movement amount Ir increasing in accordance with the increase in the pulse number (increase in plus-side or minus-side) of the pulse counter PCh and the desired movement amount Is inputted in ST1 are compared and the rebound plate 33 is moved until Ir becomes equal to Is.

ST9: The controller 7 stops driving the hydraulic motor 64 to stop movement of the rebound plate 33 when Ir becomes equal to Is.

Accordingly, the rebound plate 33 is moved by the desired movement amount, thereby adjusting the gap between the impact plate 322 and the rebound plate 33 to an appropriate amount.

Incidentally, a routine for checking normal increase in the pulse number and alarming malfunction when normal increase is not detected (corresponding to ST6 and ST9 in FIG. 9) may be added between ST6 and ST7, ST8 as necessary.

Further, in the present embodiment, though the desired movement amount Is of the rebound plate 33 is set with reference to the current position of the rebound plate 33, if it is clear that there is no deviation in the zero-point position determined in the full-auto mode, the movement amount Is may be set based on the zero-point position.

In this case, to what position relative to the zero-point position the rebound plate 33 is to be moved may be inputted as the movement amount Is.

Further, the pulse number (normally zero) of the pulse counter PCh at the zero-point position and the pulse number at the position of the current (before adjustment) rebound plate 33 may be stored and the necessary movement amount from the current position of the rebound plate 33 may be calculated based on the respective pulse number and the inputted desired movement amount Is. The rebound plate 33 is moved by the necessary movement amount.

[Gap Adjustment: Manual mode]

In the manual mode, the rebound plate located at an initial position is moved while the first and the second manual switches 503 and 504 are pressed by an operator, which is different from the above-described adjusting method conducted by operating the manipulating portion 662 of the gap adjuster 60.

Such manual mode is effective in adjusting the gap without requiring strict accuracy.

Incidentally, the movement amount while moving the rebound plate 33 or the gap amount from the zero-point position may be calculated based on the changing pulse number of the pulse counter PCh and may be simultaneously displayed on the input panel 505 etc., the operator operating the first and the second manual switches 503 and 504 while checking the display.

[Advantage of Embodiment]

According to the above-described embodiment, following advantages can be obtained.

(1) In the full-auto mode gap adjustment of the crusher 30, since the rise of the advancing-retracting portion 65 of the gap adjuster 60 caused by the contact with the rebound plate 33 and the rotor 32 and the rotation amount of the rotor 32 is detected and the zero-point position of the rebound plate 33 is determined based on the detected result, it is not necessary to bring the rebound plate into contact with the rotor rotating in high-speed to generate vibration, thereby securely determining the zero-point position.

(2) The rebound plate 33 is not vibrated, so that the zero-point determination can be conducted without being influenced by the abrasion of the rebound plate 33 and the impact plate 322. Accordingly, by adjusting the zero-point position and moving the rebound plate 33 from the zero-point position, the gaps C1 to C3 can be accurately adjusted.

(3) Since the initial contact between the rebound plate 33 and the rotor 32 is detected by the rise of the advancing-retracting portion 65 of the gap adjuster 60, the rebound plate 33 can be brought into secure contact with the rotor 32 by initially moving the rebound plate 33 down toward the rotor 32, thereby securely avoiding detection error by avoiding non-contact state.

(4) Since whether the rebound plate 33 has reached the zero-point position or not is determined by detecting the rotation of the rotor 32, even when the rotor 32 enters into the rebound plate 33, that the rotor 32 has entered into the rebound plate can be securely judged by the rotation of the rotor 32, so that there can be no trouble in determining the zero-point position even when the advancing-retracting portion 65 is not raised by the mutual contact, thereby further accurately determining the zero-point position.

(5) Further, in the automatic mode gap adjustment, since the current gap of the rebound plate 33 is recognized in advance and the rebound plate 33 is moved by the desired movement amount Is relative to the current position, it is not necessary to collide the rebound plate 33 with the impact plate 322 to vibrate, thereby accurately conducting gap adjustment.

(6) According to the automatic mode, since the movement amount Is is inputted based on the grain size of the actually obtained crushed object, the gaps C1 to C3 can be minutely adjusted in accordance with the type of the object even after the standard gap Ss is set by the full-auto mode gap adjustment, so that crushed object of more accurate grain size can be easily obtained.

(7) By setting the movement amount Is of the automatic mode based on the zero-point position, substantially the same gap adjustment as in the full-auto mode can be conducted by the automatic mode within a short time, thereby efficiently conducting the gap adjustment.

(8) Since the advancing-retracting portion 65 of the gap adjuster 60 has the screw-type mechanical moving mechanism 69 provided with the nut 66 and the bolt 67, the movement amount of the rebound plate 33 can be minutely controlled by calculating the movement amount of the rebound plate 33 using the movement amount N based on screw pitch, and the rebound plate 33 can be securely stopped at any position. Accordingly, the rebound plate 33 can be securely moved from the zero-point position by the desired gap Ss or can be securely moved from the current position of the rebound plate 33 by the movement amount Is, thereby further accurately conducting the adjustment of the gaps C1 to C3.

Since the gaps C1 to C3 can be accurately adjusted, crushed object of desired grain size can be securely obtained, thus improving quality.

Second Embodiment

Figure 12:
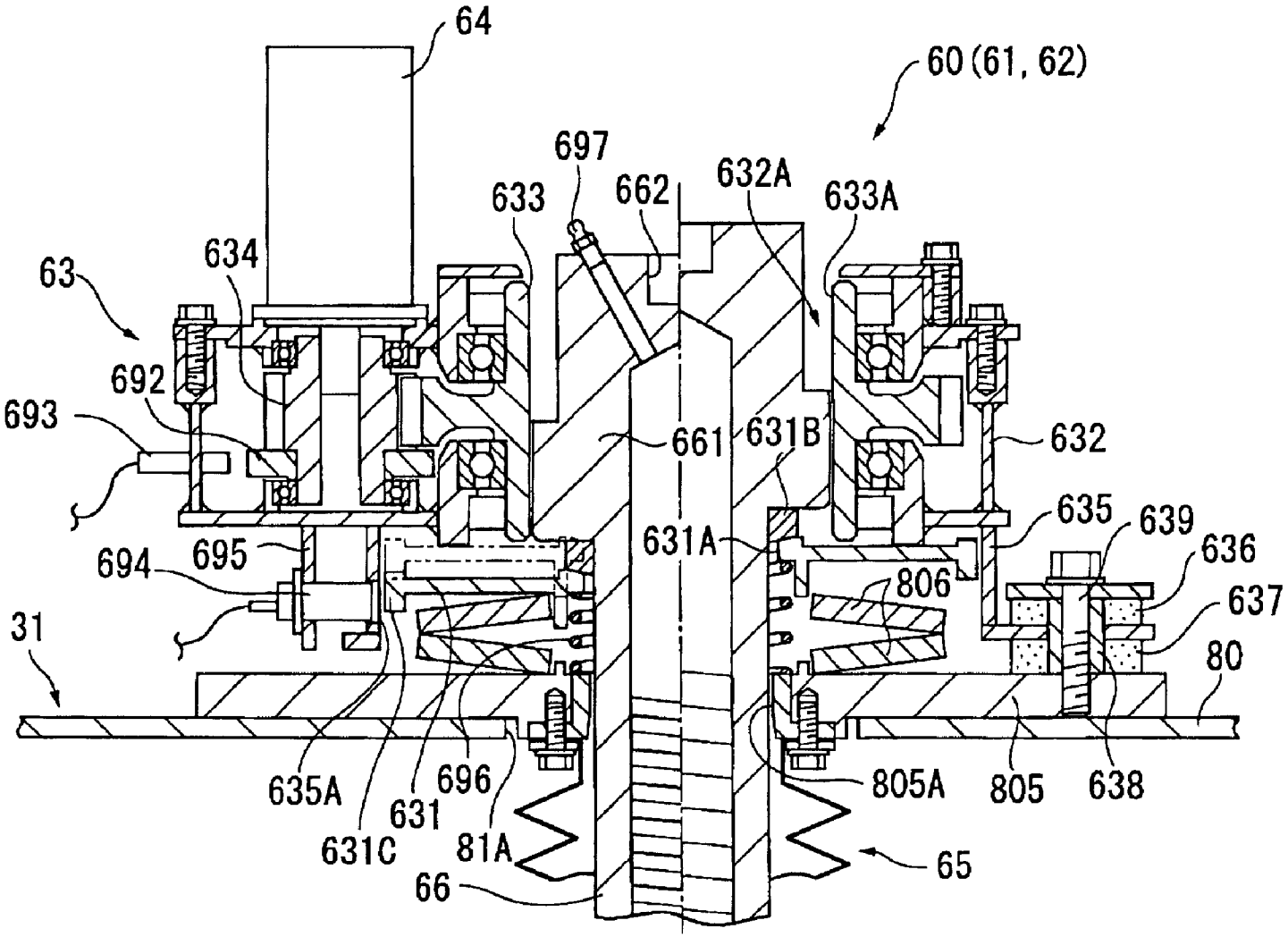
FIG. 12 is a cross section showing a primary portion of the gap adjuster according to second embodiment of the present invention.

FIG. 12 shows a primary section of the gap adjuster 60 (61, 62) according to a second embodiment of the present invention. The same component or the component of the same function as the component described in the gap adjuster 60 (61, 62) in the above-described first embodiment will be applied with the same reference numeral to omit or simplify the description therefor.

In the gap adjuster 60 of the present embodiment, the rise sensor 694 is located beneath the exterior case 632 of the drive mechanism 63 in the gap between the lower side of the exterior case 632 and the upper side of the movable case 80.

Specifically, the rise sensor 694 is supported by a support piece 695 provided on the lower side of the exterior case 632 with the tip end (detection side) being inserted into an opening 631A drilled in the vertical portion of a cylinder 635, so that outer circumference 631C of the spring-receiving plate 631 accommodated in the cylinder 635 can be detected.

On the other hand, though the spring-receiving plate 631 is merely put on the coned disc spring 806 in the above-described first embodiment, the spring-receiving plate 631 is biased upward by a helical spring 696 provided around a through-hole 805A of the mount base 805 in the present embodiment. Accordingly, when the advancing-retracting portion 65 of the gap adjuster 60 is raised, the spring-receiving plate 631 follows the advancing-retracting portion 65 to be raised upward by virtue of the spring force of the helical spring 696 (as shown in right side in FIG. 12). The outer circumference 631C of the spring-receiving plate 631 goes out of the detection range of the rise sensor 694 as shown in double-dotted line in the left side of FIG. 12, and the rise of the advancing-retracting portion 65 is detected. Accordingly, no detection plate 691 (see FIG. 6A) of the first embodiment is provided in the present embodiment.

At this time, the through-hole 631A provided on the spring-receiving plate 631 is sufficiently greater than the outer diameter of the nut 66 constituting the advancing-retracting portion 65, so that interference between the outer circumference of the nut 66 and the through-hole 631A can be avoided even when the advancing-retracting portion 65 is obliquely raised in an inclined manner, thereby smoothly moving the spring-receiving plate 631 up and down. Further, the outer circumference 631C side of the spring-receiving plate 631 is close to the inner circumference of the cylinder 635 and the spring-receiving plate 631 is vertically moved while being guided by the inner circumference, thereby restraining shakiness during movement.

Further, in the present embodiment, the manipulating portion 662 provided on the upper end of the advancing-retracting portion 65 is of polygonal (tetragonal, in the present embodiment) concave, into which wrench etc. can be inserted for rotating operation. Further, a grease nipple 697 is provided on the upper end of the advancing-retracting portion 65 keeping away from the manipulating portion 662, so that grease can be fed into the nut 66 as in the first embodiment.

According to the present embodiment, following advantages can be obtained on account of specific arrangement thereof.

(9) Since the rise sensor 694 is located beneath the exterior case 632 of the drive mechanism 63, dust etc. is not fallen and deposited on the rise sensor 694. Accordingly, the detection accuracy of the rise sensor 694 can be greatly improved and there is no need for improving the detection accuracy using a greater sensor, thereby reducing cost and size thereof. Further, since the spring-receiving plate 631 to be detected by the rise sensor 694 is accommodated in the cylinder 635, deposit of dust on the spring-receiving plate 631 side can be prevented, thereby maintaining superior detection accuracy for a long time.

Further, since the rise sensor 694 is not projected upward unlike the first embodiment, the damage on the rise sensor 694 on account of scatterings from the outside can be avoided, thereby improving durability thereof.

(10) Since the outer circumference 631C of the spring-receiving plate 631 to be detected is located close to the fulcrum (through-hole 805A of the mount base 805) when the advancing-retracting portion 65 obliquely rises in an inclined manner, fluctuation of distance between the rise sensor 694 and the spring-receiving plate 631 in accordance with the inclination of the exterior case 632 can be virtually ignored when the rise amount is small, thereby also improving the detection accuracy of the rise sensor 694.

(11) Since the outer circumference 631C of the spring-receiving plate 631 vertically moves while being guided by the inner circumference of the cylinder 635, shakiness movement during movement can be prevented and, even when the advancing-retracting portion 65 is greatly raised to incline the exterior case 632 and the rise sensor 694 greatly, the spring-receiving plate 631 can be moved in the inside of the simultaneously-inclined cylinder 635 at a constant posture, thereby securely detecting the outer circumference 631C with the rise sensor 694.

(12) Since the spring-receiving plate 631 is a component independent from the advancing-retracting portion 65 and the through-hole 631A is set sufficiently large, it is unlikely for the outer circumference of the inclined nut 66 to be brought into contact with the spring-receiving plate 631, so that the spring-receiving plate 631 can be smoothly moved.

(13) Since the detection plate 691 as in the first embodiment is not used and the manipulating portion 662 is provided on a section integral with the advancing-retracting portion 65 in the present embodiment, the structure can be simplified and the number of components can be reduced.

[Modifications]

Incidentally, the scope of the present invention is not restricted to the above-described embodiments, but other arrangement is possible as long as an object of the present invention can be attained, which includes following modifications.

Though the initial contact between the rebound plate 33 and the rotor 32 is detected by the rise in the advancing-retracting portion 65 and whether the rebound plate 33 has reached the zero-point position or not is detected based on the rotation amount of the motor 32 in the control method of the gap adjuster 60 in the first embodiment, whether the rebound plate 33 has reached the zero-point position or not may also be determined by detecting the rise of the advancing-retracting portion 65. In other words, the position of the rebound plate 33 when the rise of the advancing-retracting portion 65 is not detected in spite of the rotation of the rotor 32 may be determined as the zero-point position. Such control method and gap adjuster are well within the scope of an aspect of the present invention.

On the contrary, the initial contact between the rebound plate 33 and the rotor 32 may also be detected by detecting the rotation amount of the rotor 32 as in determining whether the rebound plate 33 has reached to the zero-point position or not. In other words, the contact between the rebound plate 33 and the rotor 32 may be determined when the rotor 32 is not rotated by a predetermined amount even after the rotor 32 is to be rotated relative to the rebound plate 33 at a predetermined position. Such control method and gap adjuster are also well within the scope of an aspect of the present invention.

Though the gap adjuster 60 in the above respective embodiments are constructed by the screw-type mechanical moving mechanism 69 having the advancing-retracting portion 65 including the nut 66 and the bolt 67, the advancing-retracting portion 65 may be a mesh-type mechanical moving mechanism having rack and pinion gear.

The connection between the rebound-plate side component (e.g. bolt component 67) and the rebound plate 33 according to the present invention may be a ball-joint type for driving the rebound-plate side component.

Alternatively, the advancing-retracting portion 65 may be a hydraulic cylinder, which can implement the control method according to an aspect of the present invention and can be applied to a gap adjuster according to an aspect of the present invention.

Though the hydraulic motors 35 and 64 are used as the rotor drive and the rebound plate drive according to the present invention in the above-described respective embodiments, an electric motor may be used instead thereof.

Though the impact plate 322 has plate-shape in the first embodiment, the impact plate according to the present invention is not restricted to have plate-shape but may be designed in any manner considering the shape of the rotor body and handlability in attachment and exchange work.

Though the mobile crushing machine 1 according to the first embodiment is self-running type having a crawler running section 10, the mobile crushing machine 1 is not restricted to employ the crawler but may have ordinary wheel, and the mobile crushing machine 1 may not be self-running type but may be a drawn-type.

The impact crusher of the present invention may not be mounted on the mobile crushing machine 1 but may be fixed at a quarry, for instance.

The specific arrangement, structure, type etc. of the controller 7, the rotor-side rotation sensor 324, the input panel 505, the rebound-plate rotation sensor 693, the rise sensor 694 etc. may be determined as long as an object of the present invention can be attained, which is not restricted to those described in the above respective embodiments.

What is claimed is:

1. A gap adjuster of an impact crusher, the impact crusher having: a rotor having an impact portion; a rotor drive for rotating the rotor; and a rebound plate spaced apart from a rotation locus of a tip end of the impact portion by a gap, the gap adjuster comprising:

a rebound plate support for movably supporting the rebound plate;

a rebound plate drive for driving the rebound plate support to move the rebound plate;

a movement sensor for detecting the movement amount of the rebound plate;

a rise sensor for detecting a rise of the rebound plate support when the rebound plate makes contact with the rotor that is stopped and when the rebound plate away from a contact position with the rotor that is stopped touches the rotor during rotation;

a set value inputting device for setting and inputting a desired gap amount between the rebound plate and the impact portion; and a controller for controlling the rebound plate drive and the rotor drive based on detection signals from the movement sensor and the rise sensor, and a desired gap amount inputted by the set value inputting device, wherein the rebound plate support is moved away from the rotor by the desired gap amount when the rise of the rebound plate support away from the contact position with the rotor that is stopped is not detected.

2. A gap adjuster of an impact crusher, the impact crusher having: a rotor having an impact portion; a rotor drive (35) for rotating the rotor; and a rebound plate spaced apart from a rotation locus of a tip end of the impact portion by a gap, the gap adjuster comprising:

a rebound plate support for movably supporting the rebound plate;

a rebound plate drive for driving the rebound plate support to move the rebound plate;

a movement sensor for detecting the movement amount of the rebound plate;

a rotation sensor for detecting a rotation amount of the rotor;

a set value inputting device for setting and inputting a desired gap amount between the rebound plate and the impact portion; and a controller for controlling the rebound plate drive and the rotor drive based on detection signals from the movement sensor and the rotation sensor, and the desired gap amount inputted by the set value inputting device, wherein the rebound plate support is moved away from the rotor by the desired gap amount when the rotation amount of the rotor exceeds a predetermined rotation amount while moving the rebound plate to be away from the rotor.

3. A gap adjuster of an impact crusher, the impact crusher having: a rotor having an impact portion; a rotor drive for rotating the rotor; and a rebound plate spaced apart from a rotation locus of a tip end of the impact portion by a gap, the gap adjuster comprising:

a rebound plate support for movably supporting the rebound plate;

a rebound plate drive for driving the rebound plate support to move the rebound plate;

a movement sensor for detecting the movement amount of the rebound plate;

a rise sensor for detecting a rise of the rebound plate support when the rebound plate makes a contact with the rotor that is stopped and when the rebound plate away from a contact position with the rotor that is stopped touches the rotor during rotation;

a rotation sensor for detecting a rotation amount of the rotor;

a set value inputting device for setting and inputting a desired gap amount between the rebound plate and the impact portion; and a controller for controlling the rebound plate drive and the rotor drive based on detection signals from the rise sensor, the rotation sensor, and the movement sensor, and the desired gap amount inputted by the set value inputting device, wherein the rebound plate support is moved away from the rotor by the desired gap amount when the rotation amount of the rotor exceeds a predetermined rotation amount while moving the rebound plate to be away from the contact position with the rotor determined by the rise sensor.

4. A gap adjuster of an impact crusher, the impact crusher having: a rotor having an impact portion; a rotor drive for rotating the rotor; and a rebound plate spaced apart from a rotation locus of a tip end of the impact portion by a gap, the gap adjuster comprising:

a rebound plate support for movably supporting the rebound plate;

a rebound plate drive for driving the rebound plate support to move the rebound plate;

a movement sensor for detecting the movement amount of the rebound plate;

a rise sensor for detecting a rise of the rebound plate support when the rebound plate makes contact with the rotor that is stopped and when the rebound plate away from a contact position with the rotor that is stopped touches the rotor during rotation;

a set value inputting device for setting and inputting a desired gap amount between the rebound plate and the impact portion; and a controller for controlling the rebound plate drive and the rotor drive based on detection signals from the movement sensor and the rise sensor, and a desired gap amount inputted by the set value inputting device, wherein the rebound plate support is moved away from the rotor to a zero-point position when the rise of the rebound plate support away from the contact position with the rotor that is stopped is not detected.

5. A gap adjuster of an impact crusher, the impact crusher having: a rotor having an impact portion; a rotor drive (35) for rotating the rotor; and a rebound plate spaced apart from a rotation locus of a tip end of the impact portion by a gap, the gap adjuster comprising:

a rebound plate support for movably supporting the rebound plate;

a rebound plate drive for driving the rebound plate support to move the rebound plate;

a movement sensor for detecting the movement amount of the rebound plate;

a rotation sensor for detecting a rotation amount of the rotor;

a set value inputting device for setting and inputting a desired gap amount between the rebound plate and the impact portion; and a controller for controlling the rebound plate drive and the rotor drive based on detection signals from the movement sensor and the rotation sensor, and the desired gap amount inputted by the set value inputting device, wherein the rebound plate support is moved away from the rotor to a zero-point position when the rotation amount of the rotor exceeds a predetermined rotation amount while moving the rebound plate to be away from the rotor.

6. A gap adjuster of an impact crusher, the impact crusher having: a rotor having an impact portion; a rotor drive for rotating the rotor; and a rebound plate spaced apart from a rotation locus of a tip end of the impact portion by a gap, the gap adjuster comprising:

a rebound plate support for movably supporting the rebound plate;

a rebound plate drive for driving the rebound plate support to move the rebound plate;

a movement sensor for detecting the movement amount of the rebound plate;

a rise sensor for detecting a rise of the rebound plate support when the rebound plate makes a contact with the rotor that is stopped and when the rebound plate away from a contact position with the rotor that is stopped touches the rotor during rotation;

a rotation sensor for detecting a rotation amount of the rotor;

a set value inputting device for setting and inputting a desired gap amount between the rebound plate and the impact portion; and a controller for controlling the rebound plate drive and the rotor drive based on detection signals from the rise sensor, the rotation sensor, and the movement sensor, and the desired gap amount inputted by the set value inputting device, wherein the rebound plate support is moved away from the rotor to a zero-point position when the rotation amount of the rotor exceeds a predetermined rotation amount while moving the rebound plate to be away from the contact position with the rotor determined by the rise sensor.

* * * * *